US005263267A

United States Patent [19]

Buttner et al.

[11] Patent Number: 5,263,267

[45] Date of Patent: Nov. 23, 1993

[54] METHOD AND APPARATUS FOR REDUCING VOLATILE CONTENT OF SEWAGE SLUDGE AND OTHER FEED MATERIALS

[75] Inventors: Thomas E. Buttner, Palos Verdes; Christopher A. Mc.Clure, Los Angeles, both of Calif.; H. Judson Buttner, deceased, late of Springville, Oreg., by Adele Buttner, personal representative; James G. McCain, Rolling Hills Estates; Arnold B. Nordstrom, Fall Brook, both of Calif.; R. Leon Williams, Eugene, Oreg.

[73] Assignee: Judco Manufacturing, Inc., Harbor City, Calif.

[21] Appl. No.: 326,212

[22] Filed: Mar. 20, 1989 (Under 37 CFR 1.47)

[51] Int. Cl.[5] ..... F26B 3/32

[52] U.S. Cl. ..... 34/39; 34/179; 34/183

[58] Field of Search ..... 34/179, 180, 181, 182, 34/136, 137, 138, 39; 432/214, 215

[56] References Cited

U.S. PATENT DOCUMENTS

| | | | |
|---|---|---|---|
| 337,560 | 3/1886 | Cook | 34/179 X |
| 1,334,495 | 3/1920 | Jackson . | |
| 3,426,838 | 2/1969 | Onarheim | 165/87 |
| 4,135,309 | 1/1979 | Bosnjak | 34/14 |
| 4,750,274 | 6/1988 | Erdman, Jr. | 34/182 X |
| 4,982,514 | 1/1991 | Ullum | 34/179 X |

FOREIGN PATENT DOCUMENTS 463633 10/1913 France .

*Primary Examiner*—Henry A. Bennet
*Attorney, Agent, or Firm*—G. Norden Hanover

[57] ABSTRACT

Apparatus for the drying of sludges and other fouling feed materials. A rotary screw type indirect heat exchanger is provided having at least one screw member. The screw member includes a helical-shaped flight having a helix angle of about 10 degrees or less and a surface roughness of about 63 micro-inches or less. Means are provided for rotating and heating the screw member and for spreading feed material onto the screw member. The apparatus operates at heat transfer rates and for a time period sufficient to reduce the moisture content of the feed material without requiring mechanical cleaning of feed material foulants from the screw member.

56 Claims, 12 Drawing Sheets

264
213,214
266
275
276
275
81
268
279
277
262
265
270
271
59
263
279
274
276
273
272

METHOD AND APPARATUS FOR REDUCING VOLATILE CONTENT OF SEWAGE SLUDGE AND OTHER FEED MATERIALS

TECHNICAL FIELD

This invention relates to methods and apparatus for reducing the volatile content of feed materials which contain one or more volatile components and may also contain one or more foulant(s). More particularly, it relates to removing at least a substantial portion of one or more removable volatile component(s) from pasty material that may include one or more foulant(s) which tend(s) to exhibit stickiness when heated and/or during removal of such volatile component(s) from the pasty material, thereby promoting adhesion of the pasty material to processing equipment. More specifically, the invention includes, among its preferred embodiments, rotary heated screw dryer methods and apparatus for the drying of waste activated sludge.

BACKGROUND OF THE INVENTION

Disposal of sludge produced as a waste product in wastewater treatment has been and continues to be a worsening problem which has had widespread and intensive attention for more than twenty years. Currently, the annual production of sludge by municipal sewage treatment plants is estimated to be in excess of seven million tons (dry basis) per year. Thus, for example, a single plant in Carson, Calif., serving a portion of the Los Angeles County area produces two hundred tons per day. It is estimated that by the year 2000, a Los Angeles, Calif. City plant located at Hyperion, Calif., will be producing over 400 tons per day of primary and activated sludges. Volumes of sludge produced are rapidly increasing, while available options for disposal are restricted or decreasing.

Principal among existing disposal methods are ocean dumping, land fill dumping, land application (e.g., to agricultural, forested and strip-mined land), and incineration. Ocean dumping is restricted by Federal legislation, and the number of incineration plants has been decreasing in recent years due in part to tightening Federal air quality regulations. Continuing concern over potential effects of transmission of the heavy metal and toxic chemical components from sewage sludges and other sludges into the food chain and ground water has restrained the growth of land application and increasingly restricted the number of landfill sites which may be used for sludge disposal. Nevertheless, as available landfill sites fill up and diminish in number, Federal policy has turned increasingly in the direction of encouraging land application with appropriate controls.

For many years it has been recognized that reduction of the water content of sludge is of great importance in implementing the majority of these disposal techniques. Excessive water content escalates incineration costs, unnecessarily increases the proportion of precious landfill space occupied by a given weight of sludge, significantly increases the number of trucks that must be used to move a given weight of sludge solids to a disposal site, limits the distance over which transport of sludge to agricultural and other land application sites is economically feasible, and must be eliminated in preparing sludge for some of its more constructive end uses. Also, it has long been recognized that removal of water from sludge reduces both its weight and volume. For example, the drying of sludge from a 90% moisture content to a 60% moisture content results in reducing the sludge weight and volume to only one-fourth of the starting amounts. This simple mathematical fact, coupled with the unruly behavior of sludge during drying, has spurred large numbers of talented engineers and researchers to devote continuing and careful attention to the development of better and more economical sludge drying equipment and techniques.

Not the least among its defiant characteristics is the slimy, gelatinous or paste-like character exhibited by many forms of sludge. Pasty sludge material tends to stick to almost everything it touches. When a layer of sticky sludge contacts the hot walls or other internal surface of a drying device, there is a tendency for it to stick tenaciously to the surfaces and to grow in tenacity as the drying process reduces its moisture content. This tenacious layer provides a foundation for the accretion of additional thicknesses of dried sludge which act as thermal insulation. Thus, when the dryer surfaces, which become coated in this manner, are the surface through which heat is intended to be transmitted to the wet sludge, drying efficiency plummets and/or the equipment must be shut down frequently for cleaning.

Throughout a lengthy search, a wide variety of systems have been proposed and used, often with unsatisfactory results or complete failure. It is notable that the various types of equipment, which have failed in sludge drying, have generally been excellent units which performed admirably in the drying of a wide variety of other materials. Among the devices proposed and used for sludge drying are: hollow disk (e.g., Envirotech Thermo-Disc (TM) dryers, which are understood to have experienced failures due to excessive erosion and corrosion when used to dry sewage sludge; thin film dryers (e.g., Luwa (TM)), which have apparently been used with some success with sludges dispersed in the form of fluent or readily flowable slurries; rotary, scraped drum dryers, which have a long history of successful operation with fluent slurries, but which tend to be thermally inefficient when applied to sewage sludges; and flash dryers (e.g., Raymond (TM)) which are understood not to have worked successfully on gelatinous wet sludges. Apparently, multi-hearth furnaces have been used at Harrisburg, Pa. and elsewhere, but the city of Harrisburg was not fully satisfied since they and their contractor, Bethlehem Steel Corporation, have engaged in a seven-year, unsuccessful effort to replace these furnaces with Bethlehem Porcupine (TM) internally heated rotary cut-flight type dryers in the drying of sewage sludge wetted primarily with water. Tray/shelf (e.g., Wyssmont Turbo (TM)) dryers have been used with some success in this application in a number of locations and are presently understood to provide the best combination of capacity, efficiency and maintenance cost currently available.

Another type of equipment which skilled workers have attempted to adapt to sludge drying is the rotary heated screw dryer. Prior workers have been attracted to this type of dryer because, in theory, it should, if it could be made to work successfully with sludge, offer more compact, sturdier installations, lower maintenance and operating costs and less difficulties with overloading than Wyssmont dryers and multi-hearth furnaces, and considerably greater thermal efficiency than the rotary drum dryers. Indeed, Perry, Chemical engineers' Handbook, McGraw-Hill Book Company, 1950, page 862, suggests drying of pasty materials with internally heated screw type dryers, and indicates that ". . . recycling of the dry product into the feed may be required to permit suitable handling in the dryer." This same work states in Table 33 on pages 872–873 that such dryers "[c]an only be used if material does not stick or cake."

In confirmation of the foregoing, the Denver division of Joy Manufacturing Company made a determined effort for years, now abandoned, to apply its highly developed and otherwise widely successful Holo-Flite (TM) heated rotary screw processors to the drying of sludge. It is understood that in their above-mentioned abortive attempt to dry aqueous sewage sludge with the Porcupine (TM) cut-flight dryers at Harrisburg, Pa., Bethlehem could not operate at recycle ratios of 3:1 and eventually experimented with recycle ratios as high as 5:1 before abandoning the project. Over a period spanning more than thirteen years, one of the present inventors, H. J. Buttner, experimented with the heated screw sludge dryers described in his U. S. Pat. Nos. 3,775,041 and 4,371,032.

Considering the heavy fouling of the heated screws that had occurred in the prior screw type devices, it seemed evident that the correct path to success in overcoming these problems would be to equip the screws with cleaning devices. This was the main thrust of the early work of Mr. Buttner, as reflected in the teachings of his above-mentioned patents. These described, respectively the cleaning of the screw flights (somewhat analogous to screw threads) and of the screw volutes (helical valleys between the flights) using recirculating balls or continuous loop scraper mechanisms having scrapers, either of which rode along in the dryer volutes with the drying sludge as the screws rotated. Unfortunately, the recirculating ball unit suffered from excessive torque build-up, leading to experimentation with the continuous loop scrapers. These kept the screws clean, but imposed relatively high production costs.

Mute testimony to the continuing lack of a fully satisfactory solution is provided by existing sludge handling practices at the above-mentioned Carson sewage treatment plant, which in part resembles what is being done at many other plants across the country. About half of the approximately 200 tons per day of sludge produced at Carson is still being trucked to landfills at a moisture level of about 80–85%, notwithstanding the above-described space and economic penalties associated with disposing of sludge in this manner. Much, if not all, of the remaining Carson sludge is sold as a soil conditioner, both in bulk and bags, operations which are benefitted significantly by drying the sludge. However, the technique currently being utilized to dry the sludge is to windrow it in the open air on approximately 40 to 50 acres of valuable land in a major industrial area, holding it there for a period of at least about a month with periodic turning over of the windrows, until it dries from its initial moisture content of 85% down to about 60%. Other communities with poorer weather conditions, lower levels of sludge production, and/or more capital to invest have turned to space- and time-consuming composting procedures in green houses and very large tanks.

For the above reasons and others, it is believed there continues to be a need for improved systems for the drying of sludge. It is the object of the present invention to satisfy this need.

SUMMARY OF THE INVENTION

Unexpectedly, the above-described need has been met in a way that permits heated rotary screw conveyors to evaporate volatile matter from sludge and other feed materials over long periods of operation without fouling, and without the necessity for using recirculating balls, endless loop scrapers or other cleaning devices which contact the screws and foulant(s). In accordance with the method of the present invention, heat is applied through a rotating screw to remove at least a substantial portion of one or more removable volatile component(s) from feed material, which may include one or more foulant(s), while maintaining good heat transfer from the screw to the feed material.

The method of the present method comprises bringing feed material into engagement with the surface of a rotating screw having specified characteristics. In addition to having at least one helical flight, the screw has at least one helical volute of open cross section extending adjacent the flight and having a roughness average (Ra) of about 63 microinches (about 1.6 micrometers) or less in that portion of its surface which contacts the feed material.

During rotation of the screw, at least one volatile component is expelled and vaporized from the feed material at the feed material/volute interface sufficiently rapidly, in sufficient quantity and on a continuing basis for retarding sticking of foulant(s) to the screw. Sufficient vaporized volatile component is removed from the feed material for substantially increasing its solids content and/or viscosity.

The feed material is conveyed in contact with the volutes of the rotating screw. Its motion includes components of motion parallel to the axis of the screw. At the same time, substantial circumferential slippage of the feed material relative to the volute surface is maintained, thereby retarding deposition of foulant(s) on the screw surface.

In addition to the foregoing, the method of the present invention includes operation of the process with one or more added refinements and improvements which are described below.

The apparatus of the present invention is useful for removing volatile component(s) from feed material including one or more of such volatile component(s). This apparatus comprises a rotatable screw having at least one helical flight and at least one helical volute of open cross section extending adjacent the flight and having a roughness average (Ra) of about 63 microinches (about 1.6 micrometers) or less in that portion of its surface which is for contacting the feed material. In combination with the foregoing is means for supplying heat to the screw during rotation thereof at a temperature and rate sufficient to maintain the volute surface(s) at a temperature which is at least about 400 degrees fahrenheit (about 205 degrees centigrade) and for directing such heat to the volute surface(s) for vaporizing and expelling such volatile component(s) from the feed material. Also included in the apparatus invention are a variety of refinements and improvements described in detail below.

VARIOUS EMBODIMENTS

Feed Materials

Figure 2:
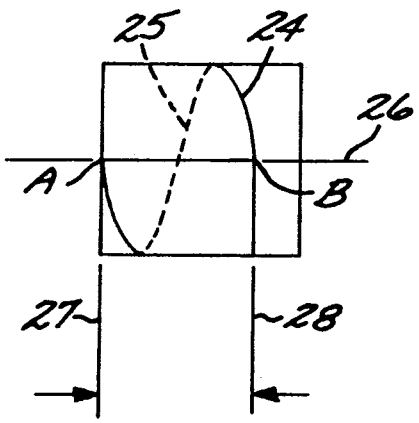
FIG. 2 is a schematic diagram of a portion of the screw in FIG. 1, illustrating the pitch of a screw helix.

This invention was developed as a solution to a long-standing and vexing problem, which has existed in the art of drying waste activated sludge, e.g., centrifuged sludge recovered from the clarifiers of activated sludge type wastewater treatment plants. However, after the invention was made it was concluded that it would be of assistance in drying and non-drying processes involving removal (including recovery) of volatile component(s) from other feed materials. For purposed of discussing the applicable feed materials and their treatment in the present specification, including the descriptive portion and claims, these definitions apply to the singular and plural versions of the following terms:

"Feed material" means a substance whose consistency is in the range extending from (and including) viscous liquid to solid form under operating conditions, and possibly also under ambient conditions, which substance includes one or more solid material(s) and one or more volatile component(s), and may also include one or more foulant(s).

"Substance" includes a single material or a plurality of materials, including mixtures.

"Operating conditions" refers to the conditions of pressure and temperature selected by the user for the operation of the process or apparatus of the present invention, and prevailing within the feed material during its progress through the process or apparatus.

"Ambient conditions" refers to standard atmospheric pressure and room temperature, i.e. 68° F. (20° C.).

A "solid material" is a substance whose physical form is a solid form (including hollow, porous, cellular and monolithic) under ambient and/or operating conditions, and which may or may not also have the ability to exist in liquid and/or gaseous (including vapor) form under these or other conditions.

A "volatile component" is a substance which is volatile (including the ability to sublimate) under operating conditions and may exist at least partly in solid, liquid and/or gaseous form under ambient and/or operating conditions. If the solid material is volatile under operating conditions, the volatile component is more volatile than the solid component.

A "foulant" is a feed material or a component of a feed material which tend(s) to exhibit stickiness when heated and/or during removal of volatile component(s) from the feed material, thereby promoting adhesion of the feed material to processing equipment, including one or more heated rotary screw(s) in contact with the feed material.

Examples of the physical forms which feed materials may take are solutions, syrupy materials, creamy materials, slurries, slushes, melts, pastes, emulsions, foams, gels, fluent sludges, dried sludges and other crumby and/or crumbly materials, shredded materials, fibers, granules, beads, and other particles. When the feed material is in a form which is or tends to remain a solid upon initial contact with the screw, it will ordinarily be fed in a size that can be readily transported by the screw, or, if supplied in larger sizes, will ordinarily be sufficiently breakable (by the screw or other means) and preferably frangible, so that it can be made to transport readily.

Preferred for use in the invention are pasty materials which include foulant(s) and which have a consistency in the range extending from (and including) pasty through crumbly (including crumby) at ambient temperature. In these preferred materials, the volatile component includes substance which is liquid at ambient temperature, ranging from a small (e.g., (1–2%) to a large amount (e.g., 90% or more) based on the total weight of pasty material. Particularly preferred are those pasty materials which are predominantly composed of, and those pasty materials which consist essentially of, organic sewage sludge with or without any of various suitable pretreatments such as for example extraction with oil according to the Carver-Greenfield process.

The invention has proven ability to evaporate and dry pasty materials with foulants, where the pasty materials are predominantly composed of, or consist essentially of, gelatinous waste organic sewage sludge in which water is the predominant (by weight) volatile component, e.g., the residue of activated sludge treatment of sewage including (without limitation) domestic waste water alone or in admixture with industrial waste water.

By way of illustration, a variety of other sludges and other feed materials may have their volatile components partially or substantially completely removed. These include sludges generally which contain solids and materials capable of advancement. Among these are inorganic sludges, e.g., metal hydroxides of aluminum and iron, and organic sludges, e.g., residues of solvent extraction and azeotropic distillation processes, including Carver-Greenfield process sludge containing about 1-2% water content, as well as mixtures of both organic and inorganic sludges. Also applicable are various foods such as cereal, scrambled eggs and dog food. Other applicable non-food items include wood pulp, extracted cotton-seeds, fish meal, extracted botanicals, extracted granular coal and animal manures. Included among the applicable volatile component(s) are inorganics, such as water, and organics, such as organic solvents or oils used to remove (including recover) oils, grease and fats by extraction, distillation or other techniques, and mixtures of organics and inorganics.

Figure 1:
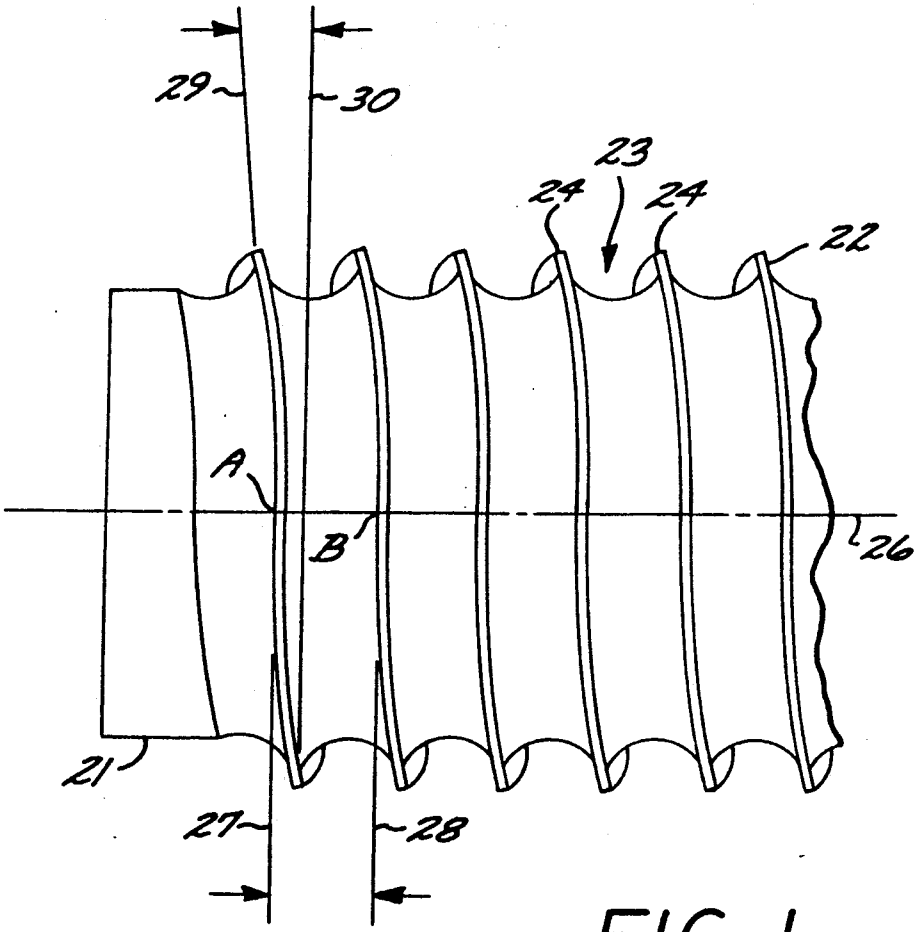
FIG. 1 is a side elevation of a portion of a screw with reference lines illustrating its pitch and helix angle.

Screws Illustrated, FIGS. 1 and 2

A portion of a representative screw useful in practicing the present invention is shown in FIGS. 1 and 2 for purposes of illustrating some of the terminology used in describing such screws. The jagged lines present in FIG. 1 and in other figures throughout the views indicate that what is shown is only a representative portion of the depicted device, the remainder being cut away or broken-out in order that the depicted portion may be shown in as large a scale as possible for clarity of illustration. Thus, it will be understood that FIG. 1 illustrates a portion of a much longer screw, and that the remainder of the screw would extend to the right of what is shown if the screw were shown in full.

In FIGS. 1 and 2, an element 21 represents the shank or main body of the screw, extending from one end of the screw to the other. Shank 21 could either constitute or be connected to a shaft for rotating the screw and could be either hollow or not. Formed about shank 21 and extending in a helical pattern along the length of shank 21 between the ends of the screw is flight 22, somewhat analogous to the protruding threads of a common machine screw. A depression which "parallels" the helical track of flight 22, positioned between adjacent tips of a flight, is referred to as the volute 23. As will be discussed in somewhat greater detail below, the practice of the present invention includes providing the screw surface with a certain surface texture or finish, it being understood that the surface referred to is that part of the screw surface which contacts the material to be dried, including the surfaces of the flight 22 and volute.

Among a number of different embodiments contemplated by the present invention are rotary screw dryers wherein the screws have specified helix angles. This is illustrated by FIG. 1, with the aid of FIG. 2, which is a schematic diagram representing one complete (360°) helical loop of a flight tip 24 as it passes downward from point A in FIGS. 1 and 2 toward the bottom of the screw, turning under the bottom of the screw into the background or hidden portion of FIG. 1, thus including a hidden portion 25, shown in FIG. 2, and then reappears at the top of FIG. 1 extending downward to point B. The longitudinal distance between point A and point B (i.e., the distance between A and B in a plane which includes screw longitudinal axis 26) is the pitch or lead of the flight. The pitch or lead is represented by reference lines 27 and 28. The helix angle of flight 22, indicated generally by reference lines 29,30, is the angle whose tangent is the result of dividing the pitch or lead by the circumference of the circle defined by flight tip 24 when viewed in a plane perpendicular to axis 26.

Screw Characteristics, Roughness (Ra)

For purposes of the descriptive and claims portion of this specification, the screw surface texture is defined in terms of Roughness average (Ra), also known as arithmetic average (AA) and centerline average. It is defined as the arithmetic average of the absolute values of the measured profile height deviations of the volute surface from the graphical centerlines of sampling locations which are substantially representative of that portion of the volute which normally contacts the feed material. For a fuller explanation of this standard, definitions of relevant terms and guidance in selection of measurement techniques, reference is made to Schubert et al., "Machinery's Handbook", twenty-first edition, Industrial Press, Inc., New York, N.Y., U.S.A., 1982, pages 2384-2391. Additional information may be found in American Standard Surface Texture (surface roughness, waviness and lay) ANSI B46.1-1978.

In general, the volutes of the screws have a roughness average (Ra) of about 63 microinches (about 1.6 micrometers) or less in that portion of their surfaces which contact the sludge. More preferably, the roughness average is about 32 microinches (about 0.8 micrometers) or less and still more preferably about 16 microinches (about 0.4 micrometers) or less. The best compromise between finishing cost and performance of the screws appears to lie in the range of about 16 to about 8 microinches (about 0.4 to about 0.2 micrometers).

Any method which produces the desired surface roughness value is acceptable. Thus, the requisite value may in some cases, with careful work, be produced in the initial screw forming procedure. For example, Schubert, et al., op. cit., p. 2389, reports that careful milling and turning techniques can produce roughness values in the above-mentioned ranges. On the other hand, if the screws are initially formed by a technique which does not produce the requisite surface texture, they may be finished by careful abrasive- or electrolytic-grinding; honing, mechanical-, chemical- or electrochemical milling; turning; polishing (including electropolishing); superfinishing; any other suitable smoothing technique; and/or any combination of suitable techniques, applied as required to properly finish the screw surfaces. Moreover, the requisite surface finish may be obtained by applying a smooth metallic electroplate, vacuum deposit or other durable surface treatment to the volute surface.

Particular attention should be given to smooth finishing of joints, concave corners and other formations in the screw surfaces which might otherwise evade finishing or serve as crevices for attachment of foulants. It is preferred to design the screws with a minimum of these types of formations. However, if present, they should be carefully processed to provide them with the indicated surface texture. Post-forming metal treatments may also be applied to improve wear and/or corrosion resistance, but care should be taken not to impair the slippage properties of the screws. Of interest in this connection are ion implantation processes, such as those which involve bombarding the near-surface regions of the metal with highly accelerated nitrogen ions. Care should be taken to avoid creating excessive differences in thermal expansion coefficient between the treated portions and the remainder of the metal that could lead to surface failure upon heating, e.g., surface crazing and/or spalling.

If the screw is fabricated from multiple pieces, additional precautions may be required. Thus, for example, if a screw is produced by welding a helically bent ribbon about a tube which will serve as the hub of the screw, the welds should be carefully polished so that they meet the recited surface roughness criteria.

A particularly preferred technique for those metals amenable thereto is to turn the screws as a single piece from an extruded billet. Such screws, as compared to those made from castings, are less likely to include faults in the form of porous sections in the screw walls, which means that they can be heated internally with heat exchange fluid with less likelihood of contaminating feed materials such as food in which such contamination is unacceptable. The volute surfaces of the turned screw are polished to the extent necessary with fine grit sandpaper and/or a polishing wheel and rouge. For a screw of the above type having a semicircular cross-sectioned volute, which has been modified by welding a radially extending helical extension to the tip of its flight, the polishing procedure preferably includes deburring the weld with a rotary deburring tool, high speed (e.g., 22,000 r.p.m. machine sanding the deburred weld and adjoining surfaces of the volute with progressively finer rotary sanding drums ranging from 40 to 240 grit with the direction of grit rotation being generally perpendicular to the helical centerline of the volute, hand sanding the entire inner surface of the modified volute (which includes the surfaces of the extension and weld) with 240 grit sand paper in a direction generally parallel to the helical centerline of the volute (i.e., the direction of slippage between the volute and the material to be dried in the apparatus), and machine polishing the entire surface of the modified volute with a rotary cloth buffing wheel and a very fine grade of polishing rouge.

A rough metal surface prior to polishing will generally include peaks and valleys visible when a cross section of the surface is examined microscopically. Polishing will at least flatten the highest peaks, and preferably flatten the surface down to about the geometrical centerline referred to above in the discussion of Roughness average. Ideally, polishing is continued to the extent that metal is removed down to the level of the bottoms of some of the lower valleys that were present in the original surface profile of the material, so that the original system of peaks and valleys is essentially, or to a very substantial extent, or even substantially completely, replaced with a new system of much smaller peaks and valleys.

Screws, Materials of Construction

Materials of construction for the screws are selected based on such criteria as mechanical properties (ability to withstand the mechanical stresses of dryer operation), thermal conductivity, abrasion and corrosion resistance (insofar as required by the intended application of the dryer), economy, and ease of fabrication with the requisite texture. The preferred metals for the screws, or at least the screw surfaces, are non-ferrous metals and alloys.

For high abrasion applications, Corten and titanium are of interest. In highly corrosive feed materials, chromium-plated steel and alloys such as MP35N should be considered. From the standpoint of thermal conductivity, magnesium and beryllium-copper alloys are also of interest. In practice, the material selected will represent a compromise from among the indicated criteria.

It has been found that through judicious selection, one can locate suitable metals of moderate softness which are therefore self-polishing when rotated in contact with the feed material at the elevated temperatures contemplated for this process. Thus, for the drying of waste sewage treatment sludge, screws whose feed material contacting surfaces are formed of aluminum and/or its alloys are particularly suitable. Aluminum alloys are preferred, and it appears that 6061-T6 has proven best among the materials used up to now. Aluminum (including aluminum alloy) screws appear to offer 4 to 5 times the heat transfer rate of otherwise comparable iron screws, thus facilitating the rapid transfer of heat which is particularly useful in attaining the desired rapid expulsion of volatile component from the feed material at the volute/feed material interface.

Spatial Relationships, Flights

A number of the spatial relationships of the components of the screw(s) employed in the method and apparatus of the present invention may be varied considerably without departing from the spirit of the invention. For example, it is possible to vary flight positions, number, helix angle, pitch and longitudinal thickness. For example, the flight(s) may be positioned on an internal surface of the screw which will contact the feed material, and the screw can be heated from the outside, or by means within the screw wall. However, external positioning of the flight(s) on the screw is preferred for ease in fabrication and heat delivery. It is entirely acceptable to provide a screw, or to provide each screw, with multiple flights. However, single flight screws are preferred for simplicity.

As indicated by the discussion of FIGS. 1 and 2, above, the helix angle is defined as the angle at which flight traverses a plane through the screw perpendicular to the screw longitudinal axis and is calculated by finding the angle whose tangent is equal to the screw pitch divided by its circumference along one complete turn along the tip of the flight. This angle influences the force per unit area exerted by the volute surfaces against the feed material and can therefore also influence the tendency of that material to adhere to the volute surface. Unit force increases with increasing helix angle; therefore, when working with particularly adherent materials it is recommended that the helix angle be sufficiently small for maintaining the force per unit area applied by the rotating screw(s) against the feed material at a sufficiently low level for resisting adherence of feed material to the screw. A general relationship establishing the maximum acceptable angle for all materials does not exist, but it is believed that in the case of waste sludge processing the best results will be attained by restricting dryer screw helix angles to about 10 degrees or less, more preferably about 8 degrees or less and most preferably about 6 degrees or less. It is believed that about 4 degrees or less represents the best mode for practicing the invention.

As indicated by the discussion of FIGS. 1 and 2, pitch is the distance between centers of tips on adjacent loops of a given flight as viewed in a radial plane, a plane which includes the screw longitudinal axis. Pitch is a function of the diameter of the screw, the number of flights and their helix angle. In general, where the helix angle is to be restricted as discussed above, the pitch will be selected in reference to the factors referred to in the foregoing sentence to provide the desired helix angle.

The longitudinal thickness of the flights is not limited in principle. However, excessive thickness limits dryer capacity and performance and (depending on the design of the housing) can result in wedging of material with high unit force against the housing. Therefore, it is preferred that flight thickness at the tip be as thin as practical. The flight depth in the radial direction is discussed below in connection with the volute characteristics.

Spatial Relationships, Volutes

Volute depth, which will in most cases be equivalent to the radial extension of the flights, is limited for assisting in controlling adherence of feed material to the volute surfaces. Preferably, volute depth does not exceed the pitch of the screw, the tip-to-tip distance between adjacent loops of the screw flight or flights.

One may also vary the surface contours of the volutes as viewed in radial planes (planes which include the screw longitudinal axis), but it appears possible to inhibit or control fouling of the screw(s) through proper selection of these contours. Preferably the contours of the sides of the volutes, viewed in the above-described manner, are not substantially convergent with one another in the radially outward direction. This assists in inhibiting adherence of feed material to the volute surfaces. Although volute cross sections with parallel sides are contemplated, those with contours that are substantially divergent in the radially outward direction may be of assistance in controlling adherence of feed material to the volute surfaces under the conditions described herein.

Volute contours whose cross section(s) is (are) gently curved and divergent are preferred. More preferred are cross section(s) which are elliptical and divergent. Those which are semi-circular and divergent are particularly preferred. The latter are particularly easy to form, readily resist adherence of feed material under the conditions described herein and are particularly convenient for use with cleaning members such as the balls and continuous loops scrapers shown in U.S. Pat. Nos. 3,775,041 and 4,371,032 to Horace J. Buttner. Nevertheless, operation without volute-contacting cleaning members is both a preferred mode and evidence of the non-obviousness of the present invention.

Screw Construction

Various methods of screw fabrication may be used. One currently preferred alternative which has been tried successfully and has been referred to above, is to turn the screw(s) from extruded billet(s) and polish as above described. Another is to form contiguous helical windings of tubular stock (e.g., titanium) around a mandrel; weld adjacent loops of helical tube together from one end of the helix to the other; grind away the outer half of the helical tube; remove the mandrel; form and attach shaft extensions at each end of mandrel; and polish the outer surface as above described. Still another method, which may ultimately prove to be the best, would be to proceed as in the preceding sentence, but from the beginning of the operation replace the mandrel with a hollow tube which will become the shaft for the device; continuously weld or tack weld the helix to the shaft as the helix is formed; form openings through the shaft wall for passage of heat transfer fluid into and out of the enclosures formed between the shaft and the helix; and polish.

With screws having external flights, the internal structure may take a variety of forms. For example, where a screw is to be heated electrically by resistance elements, the central portion of the screw may be essentially solid, i.e., non hollow, except for the presence of such bores or passageways as may be required to house the heating elements. However, the preferred arrangement, as will be illustrated in connection with FIGS. 4–11 below, is to employ at least one hollow screw whose hollow interior includes (is or contains) passage(s) for heating fluid, preferably a liquid, and still more preferably in a thin film arrangement.

Screw Parameters, Preferred Combinations

Certain combinations of the foregoing parameters are employed in particularly preferred embodiments of the method and apparatus of the present invention. For example, it is preferred to use a combination in which the screw(s has (have) its (their) flight(s) formed on the exterior(s) of the screw(s), the flight(s) have a helix angle sufficiently small for maintaining the force per unit area applied by the rotating screw(s) against the feed material or sludge at a sufficiently low level for resisting adherence of feed material or sludge to the screw(s), the cross section(s) of the volute(s) is (are) divergent or not substantially convergent in the radially outward direction for assisting in controlling adherence of feed material or sludge to the volute surface(s), and the roughness average (Ra) of the screw(s) is 32 microinches (about 0.8 micrometers) or less in that portion of its (their) surfaces which contact(s) the feed material or sludge. In a highly preferred species of the foregoing combination, the roughness average (Ra) is preferably about 16 microinches (about 0.4 micrometers) or less, with or without using the even more highly preferred option of a screw formed from non-ferrous metal or alloy. A particularly preferred combination is to use the first mentioned combination of this paragraph with a screw which is formed from aluminum metal or alloy and which has a roughness average (Ra) of about 16 microinches (about 0.4 micrometers) or less. Also highly desirable are combinations of any of the foregoing variations in which the screw flight(s) has or have a helix angle of about 10 degrees or less, more preferably about 8 degrees or less, still more preferably about 6 degrees or less and most preferably about 4 degrees or less for maintaining the force per unit area applied by the rotating screw(s) against the feed material or sludge at a sufficiently low level for resisting adherence of feed material or sludge to the screw(s).

Screw Filler

According to one optional but advantageous and preferred alternative which may be used with any of the method and apparatus embodiments herein, the screw is arranged to be heated from within by a thin film of heat exchange fluid, preferably a liquid. Thus, the unit may include wall means in the screw(s) supporting the flight(s) and having an inner surface surrounding and defining a heating chamber which is located within the screw(s). This chamber preferably has a volume exceeding half the total volume of the screw(s) within which it is located. Means are also provided for supplying and withdrawing a flow of heat exchange fluid to and from the heating chamber. According to this preferred embodiment, a filler means is secured within the heating chamber. It is a member having a volume exceeding half the volume of the heating chamber and an outer surface which, over a major portion of such outer surface, confronts, is spaced apart from and is closely adjacent to the wall means of the screw(s) for forming the heat exchange fluid into at least one layer or stream of narrow thickness measured across the space between said outer and inner surfaces. Narrow thickness of the layer(s) and/or stream(s) promotes rapid transfer of heat from the heat exchange fluid to the screw(s) and feed material.

Sealing Aspects

Among the optional but beneficial refinements and improvements included in the apparatus of the present invention are various preferred embodiments which relate to sealing. These include sealing of the housing in which the screws are mounted. Another aspect of sealing includes protection of seals and bearings.

With respect to housing sealing, it is preferred that the screw(s) be mounted within a substantially gas-tight housing having an inlet and an outlet for introducing and discharging feed material, and that gas-lock means are positioned at the inlet and outlet for permitting passage of incoming and outgoing feed material while inhibiting interchange of gases within the housing with ambient gases. As an optional but preferred embodiment of the foregoing, the gas-lock means includes a screed member positioned at the inlet for striking off the upper surface of material fed through the inlet to the screw(s).

With respect to protection of seals and bearings, the invention offers a number of preferred alternatives that are especially useful when the method or apparatus is practiced or embodied in apparatus having one or more shafts heated by direct or indirect contact with heat exchange fluid. Such embodiments will often include a housing to which are secured bearing means for receiving and rotationally supporting axially extending shafts secured to the screw(s). Seals may be provided for isolating the bearing means from sources of gases, liquids and/or solids within the housing. Moreover, at least one fluid conducting shaft may be included among the axially extending shafts and may have wall means which includes an external surface in contact with the bearing means and which also surrounds at least one longitudinally extending heat exchange fluid passageway formed within the shaft. Any or all of the following features may be used with the foregoing combination.

One such feature includes providing the fluid conducting shaft with wall means which includes voids of sufficient radial thickness and sufficient longitudinal and angular dimensions for substantially increasing transmission of heat from fluid within the heat exchange fluid passageway to the shaft external surface.

Another such feature involves providing apparatus wherein the seals and bearing means are ring-like members disposed in an abutting, coaxial, annular array of such ring-like members, said array including a cooling ring among the ring-like members for withdrawing heat from the array. In a preferred species with this feature, the cooling ring includes at least one channel in or on the ring for conducting cooling fluid from an external source of such fluid into said array. The foregoing specie may be used alone or in combination with a further preferred specie wherein the cooling ring has a surface in contact with the fluid conducting shaft, and the channel(s) include(s) means for bringing cooling fluid into contact with the external surface of the shaft. Preferably, and especially when cooling fluid is brought in contact with the shaft surface, the array includes seals for isolating the bearing means from the cooling ring and that portion of the shaft external surface contacted by the cooling fluid.

Still another feature for protecting bearings and seals involves the use of a viscous semi-solid barrier material such as lubricating grease. According to this aspect, the bearing means and seals are preferably connected and in communication with a pressure reservoir for providing, during operation of the apparatus, a continuing supply of grease under pressure to a zone separated by the seals from sources of gases, liquids and/or solids within the housing.

Other Processing Options

In general, the invention is capable of use in a wide variety of processing modes which involve heating and removal of one or more volatile components from feed material, including modes with and without permanent separation of the volatile component from the feed material. For example, the removed volatile component may be re-incorporated in the feed material within or without the chamber which houses the screws used in the method, immediately upon expulsion from the feed material/volute interface or after a period of delay. However, the principal applications of the invention will involve permanent removal (with or without recovery) of volatile component(s) from feed material, and will most commonly involve evaporation and/or drying, which term refers to production of a product which is not wet to the touch, but does not require complete removal of the volatile content of the feed material. Also, the contemplated processing modes include those which do and do not involve chemical and/or physical reactions of the feed material, and it should be understood that the term feed material, as used herein, is broad enough to describe both the unreacted feed material and its reaction products, even though the reaction products differ significantly in their characteristics as compared to the unreacted feed material.

Two useful feed material preparation options include preheating and lump-breaking. Preheating is discussed below in connection with FIGS. 16 and 17. "Lump-breaking", the breaking up of lumps in the feed material prior to and/or during treatment in the method or apparatus of the invention, is described below.

Although not always required, lump-breaking often helps drying efficiency. For example, one could dry sludge from 85% (by weight) water content down to about 50% water content for landfill disposal without lump-breaking. Examples of use of lump-breaking prior to drying could include use on "crumbly" dryer feed with, for example less than 67% or less than 60% moisture content. Use during drying could be practiced when drying feed material having less than 50% moisture for making 40% nitro-humus or for making 10% boiler fuel. This may involve a drying sequence of (a) partially drying, until material dries to "case-hardened" balls (e.g. about marble-sized), (b) lump-breaking (pulverize in rotary knife or hammer-mill type device), and (c) continuing drying of the pulverized material.

The rotation rate of the screw(s) may be varied widely. Care should be taken to see that the rotational speed is not so slow as to promote sticking of the feed material to the screw(s). However, high speed improves mixing and drying efficiency. In actual practice, units with twin counter-rotating screws of about 10–12 inches (25–30 centimeters) should operate smoothly and with good efficiencies at speeds in the range of about 15 to about 25 or more revolutions per minute, with about 22 r.p.m. being recommended for the screw arrangement shown in FIG. 15, below. Somewhat higher speeds may be optimum for the screws of FIG. 16, below. Simple experiments should readily show what speeds are best for operation of devices with screws of different designs and dimensions.

Where plural screws are used, their axes need not be in parallel alignment, but preferably are so. Pairs of screws may have their flights in closely spaced relationship along substantial portions of their length even in the absence of parallel shaft axes, if the screws are tapered. However, from the standpoints of ease and economy of construction, it is preferred to use screws which are of constant diameter throughout most, if not all, of their length and to position the screws with their axes in parallel alignment.

Co-rotating plural screws can be used for some embodiments of the present invention, meaning that the screws, when viewed from the end, will all be seen to be operating in either clockwise or counter-clockwise rotation. When co-rotating screws are used and laid in an inclined or generally horizontal arrangement, their direction of rotation can be established so that the material in the mixing zone between the flights of the screws will be forced either upward or downward. On the other hand, counter-rotating screws work to particular advantage with center spreaders, to be discussed in greater detail hereafter, if their directions of rotation is established to lift material between them.

The use of particularly rapid heating of the feed material with elevated temperatures in the operation of the method and apparatus is believed to contribute in substantial degree to the ability of the screw(s) to resist adherence of the sludge or other feed material. The rapid vaporization and expulsion of vapor at the volute-feed material interface and their beneficial effects are promoted by rapid heating of the material using elevated screw temperatures.

Preferred and more preferred rates and temperatures may for example be expressed in terms of their relationship to the boiling point of whatever volatile component is to be removed through use of the invention. Thus, one may conduct the method so that heat is supplied to the screw(s) at a temperature and rate sufficient to maintain the volute surface(s) at a temperature which is preferably at least about 190 degrees fahrenheit (about 105 degrees centigrade), more preferably at least about 240 degrees fahrenheit (about 130 degrees centigrade), and still more preferably at least about 290 degrees fahrenheit (about 160 degrees centigrade), above the boiling point, at prevailing pressure conditions, of a volatile component to be removed from the feed material.

In the alternative, for example, when the volatile component is water, e.g., the water content of aqueous sludge, preferred and more preferred rates and temperatures may, for example, be expressed in terms of particular temperatures. For example, the method is preferably carried out by supplying heat to the screw(s) at a temperature and rate sufficient to maintain the volute surface(s) at a temperature which is at least about 450 degrees fahrenheit (about 230 degrees centigrade), more preferably at least about 500 degrees fahrenheit (about 260 degrees centigrade), and still more preferably in the range of about 550 to about 650 degrees fahrenheit (about 290 to about 345 degrees centigrade).

As indicated above, one of the indicators of non-obviousness of the present invention is its ability to operate with very good heat transfer rates for extended periods without shut-down for cleaning and without scrapers and the like contacting the screw. Thus, one of the embodiments of the invention includes a method combined with any of the other embodiments described herein, which is conducted in one or more continuous or discontinuous periods totalling at least about five cumulative hours, more preferably at least about thirty cumulative hours, and still more preferably at least about two thousand cumulative hours of operation during which the screws remain substantially clear of foulant deposits and are not cleaned with scrapers, balls or alternative cleaning means other than dried sludge or other feed material wiping the volute/feed material interface(s) of the screw(s).

Another indicator of the non-obviousness of the present invention is its ability to operate on aqueous sludges with very good heat transfer rates for extended periods without shut-down for cleaning and without scrapers and the like contacting the screw. Thus, another of the embodiments of the invention includes a method combined with any of the other embodiments described herein, which is conducted with reduction of the sludge water content from about 80 percent or more in the sludge entering the process to about 45 percent or less in the sludge recovered in the process, during which the screws remain substantially clear of foulant deposits and are not cleaned with scrapers, balls or alternative cleaning means other than dried sludge wiping said interface(s). According to additional embodiments, the sludge water content is reduced from about 70 percent or more in the sludge entering the process to about 50 percent or less in the recovered sludge, or from about 60 percent or more in the entering sludge to about 50 percent or less in the recovered sludge, during which the screws remain substantially clear of foulant deposits and are not cleaned with scrapers, balls or alternative cleaning means other than dried sludge or other feed material wiping the volute/feed material interface(s) of the screw(s).

Yet another indicia of non-obviousness of the method and apparatus of the invention involves the practice of blending dried product with wet feed material at the beginning of drying. As described in the Background of the Invention section above, conventional wisdom prevalent in the art indicated that recycling of the dry product into the wet feed may be required to permit suitable handling in heated rotary screw dryers, and that such dryers can only be used if the feed material does not stick or cake. In the same section, herein, it was indicated that aqueous sewage sludge was not dried successfully with rotary cut-flight dryers at recycle ratios of 3:1 and as high as 5:1, meaning that the process was not successful even though from 67% to 80% by weight of the material occupying the available processing space in the dryer had previously been dried. Thus, although the invention permits the recycling of wet feed into the method and apparatus in any proportions, the nonobviousness of the invention is clearly indicated by the fact that it can dry aqueous waste activated sludge at dried material recycle ratios of 5:1 or less, and more preferably 3:1 or 1:1 or less, based on the weight of the wet and dried materials. Even more unexpected is the fact that the invention has made possible heated rotary screw drying of aqueous waste-activated sludge in the substantial absence of recycling of dried product, during which the screws remain substantially clear of foulant deposits and are not cleaned with scrapers, balls or alternative cleaning means other than dried sludge or other feed material wiping the volute/feed material interface(s) of the screw(s).

The invention provides additional advantages. When used to dry sludge, the invention kills pathogens without lengthy space-consuming composting procedures. Municipal, county, state and private sewage treatment facilities can dry sludge without composting, without the necessity of building greenhouses and without suffering the ruinous effects of rainy seasons, repeatedly occurring heavy dew or long periods of cold, overcast climatic conditions.

Specific Embodiments

The following are specific embodiments of the invention, among which is the mode currently believed best for practicing the invention. It will be understood that these embodiments are offered by way of illustration, and with the understanding that the invention is not limited to the specific embodiments described below.

Figure 3:
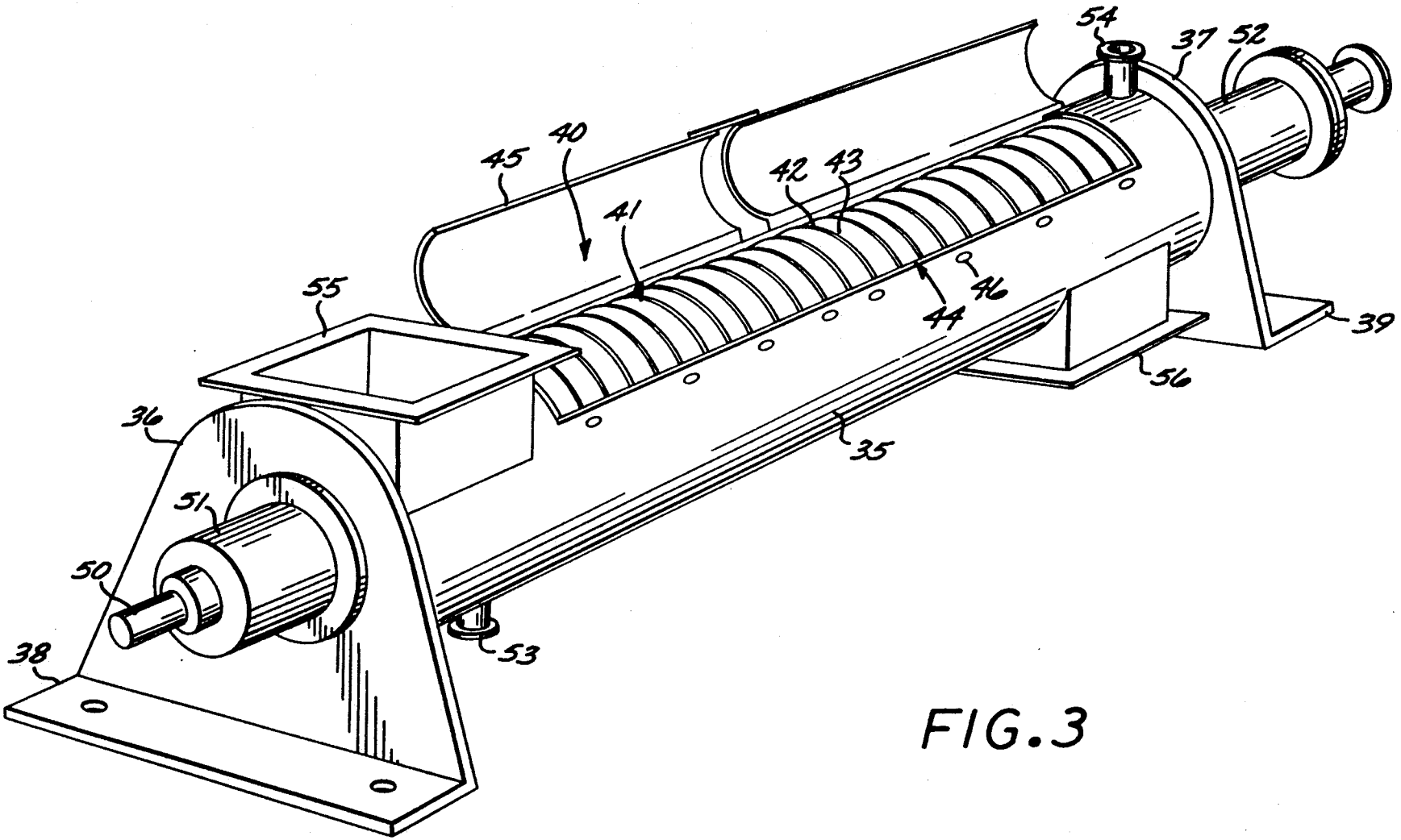
FIG. 3 is a perspective view of an illustrative single screw apparatus for conducting the process of the present invention.

Single Screw Unit, FIG. 3

A single screw embodiment of the present invention includes a cylindrical housing 35 having end plates 36 and 37 and a plurality of bottom flanges 38 and 39 for securing the housing to any suitable foundation or support (not shown). Mounted for rotation within housing 35 is screw 40 having screw surface 41, flight 42 and volute 43, visible through a hatch 44 formed and extending longitudinally in the apex of housing 35 and having closeable hinged covers 45 with fasteners 46 to retain the covers in Closed position. Screw 40 is equipped with axial shafts extending away from the ends of the screw at both ends, one such shaft, shaft 50, being shown in FIG. 3. Each of the aforementioned shafts is journalled in bearings mounted in bearing housings 51 and 52, bearing housing 52 being equipped, if desired, with a manifolding arrangement, which could, for example be that shown in FIGS. 5–7, discussed below, for admitting and discharging any suitable hear exchange fluid, for example steam, hot oil, Dowtherm (TM) or the like, to and from ,the interior of the screw. The walls of housing 35 may, if desired be hollow to form a jacket surrounding screw 40. In such case, the aforementioned jacket may be provided with fluid inlet 53 and fluid outlet 54 to admit and discharge heat exchange fluid to and from the jacket. Wet feed material may be introduced into housing 35 and brought into contact with screw 40 through wet material inlet 55, which may also serve as an outlet for steam and/or other vapors generated by the heating of material in contact with screw 40. Outlet 56 communicating between the screw and the outside of housing 35 is for the discharge of dried material.

Plural Screw Units, FIGS. 4–13

Included in the invention are certain refinements and improvements upon the general method described under Summary of the Invention above. Among these is a method comprising bringing feed material into engagement with the surfaces of a plurality of rotating screws. Each screw has an outer surface on which is located at least one outwardly projecting helical flight and at least one helical volute which has an open and at least partly concave cross section extending adjacent the flight. Each screw also has a roughness average (Ra) of about 63 microinches (about 1.6 micrometers) or less in that portion of its surface which contacts the feed material. This plurality of screws includes one or more pairs of screws, in which the flight(s) of at least a portion of one screw are positioned closely adjacent the flight(s) of at least a portion of the other screw to provide an elongated mixing zone in which the pair(s) of screws co-act upon feed material which passes between them. In this context, "closely adjacent" includes both tip-to-tip and intermeshing arrangements, as will be discussed in connection with FIGS. 14–16, below.

During rotation of the screws, at least one volatile component is vaporized and expelled from the feed material at the feed material/volute interfaces sufficiently rapidly, in sufficient quantity and on a continuing basis for retarding sticking of the foulant(s) to the screw, and for removing sufficient vaporized volatile component from the feed material for substantially increasing its solids content and/or viscosity. During the foregoing, feed material is conveyed through at least a portion of the mixing zone in contact with the volutes of the rotating screws with components of motion parallel and tangential to the axes of the screws, while maintaining substantial circumferential slippage of the feed material relative to the volute surfaces for retarding deposition of foulant(s) on the screw surfaces. This causes the feed material to progress downstream in the mixing zone.

According to a more specific and preferred embodiment of the foregoing method, at least a substantial portion of the water is removed from feed material which includes aqueous waste activated sludge. The sludge may include one or more foulant(s) and may tend to exhibit tackiness when heated and/or during removal of water and possibly of other volatile component(s) from the sludge, thereby promoting adhesion of the sludge to processing equipment.

According to this embodiment, the plurality of rotating screws have at least one helical flight with a helix angle sufficiently small for maintaining the force per unit area applied by the rotating screws against the sludge at a sufficiently low level for resisting adherence of sludge to the screws. The respective screws include at least one helical volute extending adjacent the flight(s) on the screws and having an open cross section which is divergent or not substantially convergent in the radially outward direction for assisting in controlling adherence of sludge to the volute surfaces. The feed-material surfaces of the screws are characterized by a roughness average (Ra) of about 63 microinches (about 1.6 micrometers) or less in the portions of their surfaces which contact the sludge. Also, the plurality of screws includes one or more pairs of counter-rotating screws, in which pair(s) the axes of the screws are held in substantially parallel alignment and the flight(s) of at least a portion of one screw are positioned closely adjacent the flight(s) of at least a portion of the other screw to provide an elongated mixing zone in which the pair(s) of screws coact upon sludge which passes between them.

During rotation of the screws, heat is supplied to the screws at a temperature and rate sufficient to maintain the volute surfaces at a temperature which is at least about 400 degrees fahrenheit (about 205 degrees centigrade). Also, water is vaporized and expelled from the sludge at the sludge/volute interfaces sufficiently rapidly, in sufficient quantity and on a continuing basis for retarding sticking of the foulant(s) to the screws, while removing sufficient vaporized water from the sludge for substantially increasing its solids content.

Sludge is conveyed in contact with the volutes of the rotating screws with components of motion parallel to the axes of the screws while maintaining substantial circumferential slippage of the sludge relative to the volute surfaces, for retarding deposition of foulant(s) on the screw surfaces, thereby causing the feed material to progress downstream in the mixing zone. Lifting of the sludge is brought about by co-action of up-running portions of the screws which cause the sludge to move generally upward from the elongated mixing zone between the screws with a tangential component of motion and to move downstream along an upper portion of the mixing zone.

The present invention also contemplates refinements upon the basic apparatus invention described above, including units having a plurality of rotatable screws. Each has an outer surface on which is located at least one outwardly projecting helical flight and at least one helical volute which has an open and least partly concave cross section extending adjacent the flight and having a roughness average (Ra) of about 63 microinches (about 1.6 micrometers) or less in that portion of its surface which contacts the feed material.

The screws include one or more pairs of screws, in which pair(s) the flight(s) of at least a portion of one screw are positioned closely adjacent the flight(s) of at least a portion of the other screw to provide an elongated mixing zone in which the pair(s) of screws coact upon feed material which passes between them for conveying the feed material through at least a portion of the mixing zone in contact with the volutes of the rotating screws. These screws are means for conveying the feed material with components of motion parallel and tangential to the axes of the screws, while maintaining substantial circumferential slippage of the feed material relative to the volute surfaces for retarding deposition of foulant(s) on the screw surfaces, thereby causing the feed material to progress downstream in the mixing zone.

Included in the apparatus is means for supplying heat to the screws during rotation thereof at a temperature and rate sufficient to maintain the volute surface(s) at a temperature which is at least about 400 degrees fahrenheit (about 205 degrees centigrade) and for directing such heat to the volute surfaces for vaporizing and expelling such volatile component from the feed material.

A particularly preferred embodiment of the foregoing apparatus is useful for removing volatile component(s) from waste activated sludge and/or other feed material including one or more of such volatile component(s) and one or more foulants. The rotatable screws of this embodiment have on their exterior surfaces at least one helical flight having a helix angle sufficiently small for maintaining the force per unit area applied by the rotatable screw against the feed material at a sufficiently low level for resisting adherence of such sludge to the screw. On the screw exterior surfaces are at least one helical volute extending adjacent the flight and having an open cross section which is divergent or not substantially convergent in the radially outward direction for assisting in controlling adherence of such sludge to the volute surfaces. The foregoing features are employed in combination with a roughness average (Ra) of about 63 microinches (about 1.6 micrometers) or less in that portion of the screw surfaces which contact the sludge and/or such other feed material.

The plural screws include one or more pairs of counter-rotating screws, in which pair(s) the axes of the screws are held in substantially parallel alignment. The flight(s) of at least a portion of one screw are positioned closely adjacent to the flight(s) of at least a portion of the other screw to provide an elongated mixing zone in which the pair(s) of screws coact upon feed material which passes between them for conveying the feed material through at least a portion of the mixing zone in contact with the volutes of the rotating screws. As in the prior apparatus embodiment, these screws are means for conveying the feed material with components of motion parallel and tangential to the axes of the screws, while maintaining substantial circumferential slippage of the feed material relative to the volute surfaces for retarding deposition of foulant(s) on the screw surfaces, thereby causing the feed material to progress downstream in the mixing zone.

This embodiment, in common with the prior one, includes means for supplying heat to the screws during rotation thereof at a temperature and rate sufficient to maintain the volute surface(s) at a temperature which is at least about 400 degrees fahrenheit (about 205 degrees centigrade) and for directing such heat to the volute surfaces for vaporizing and expelling such volatile component from the feed material.

Figure 4:
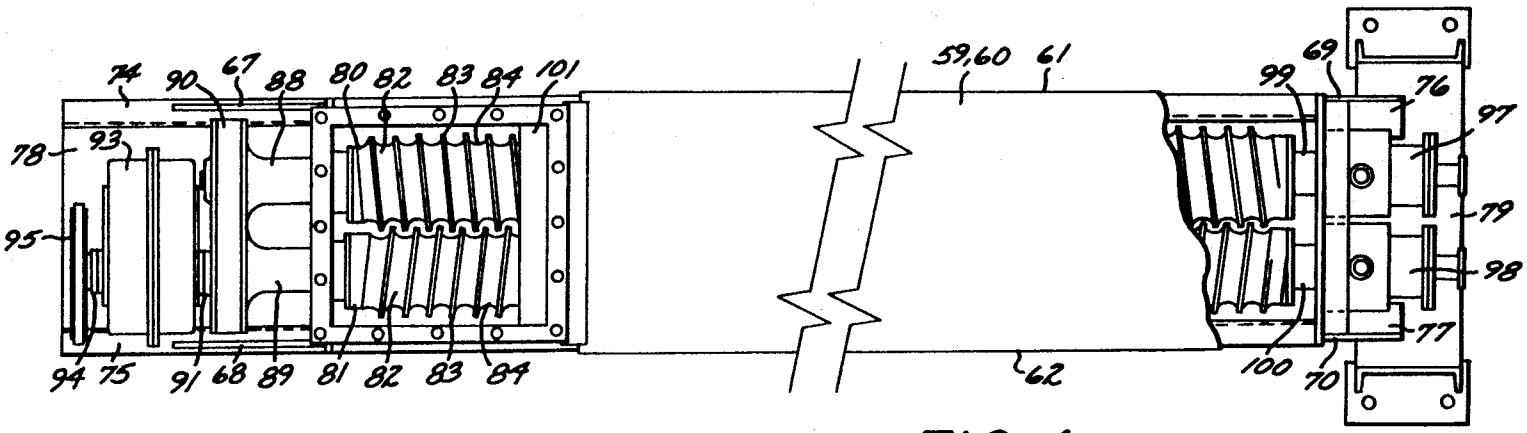
FIG. 4 is a plan view, with portions broken out, of a twin-screw apparatus for conducting the process of the present invention.
Figure 5:
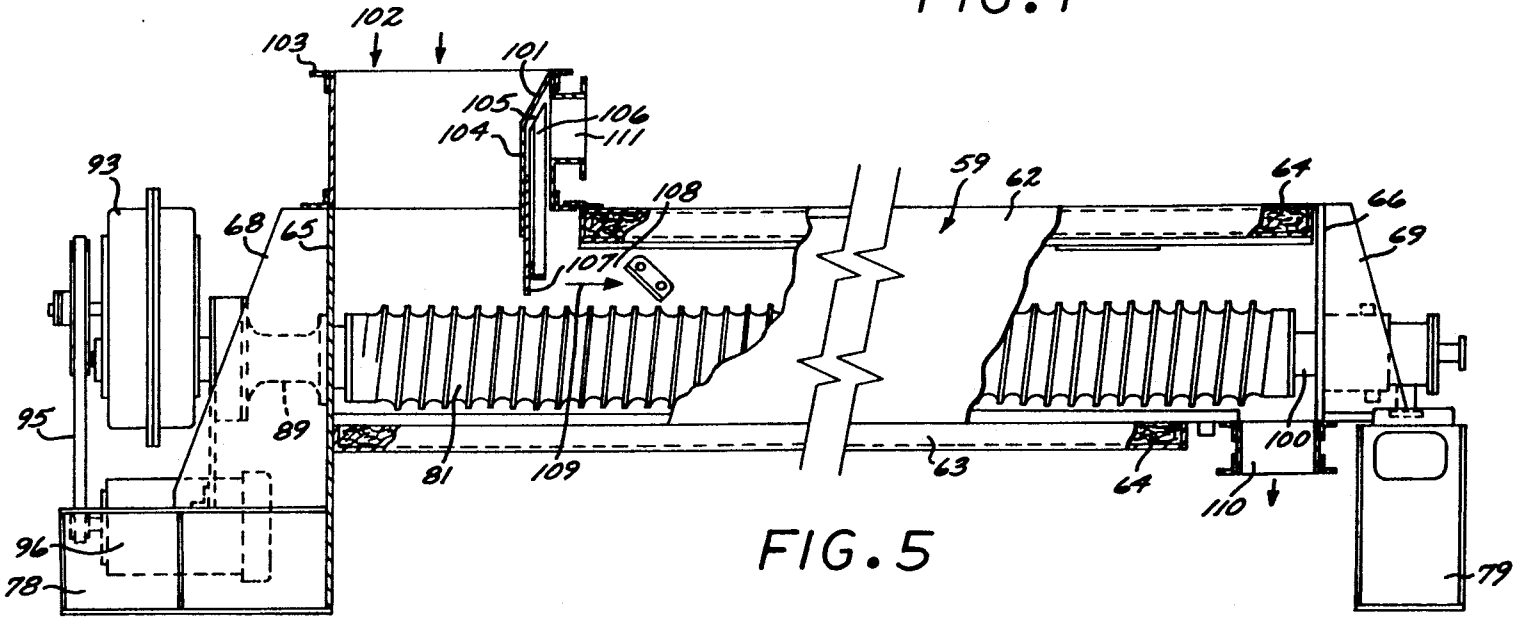
FIG. 5 is a side elevation, also with portions broken out, of a twin-screw apparatus of FIG. 4.

FIGS. 4 and 5

A counter rotating twin screw embodiment of the invention is disclosed in FIGS. 4–10, FIGS. 4 and 5 being respectively top and side views. The jagged lines in these figures show that portions of the apparatus, located between the jagged lines, have been removed from the views in order that the portions which are shown may be shown on a larger scale for the sake of clarity. Enlarged views of the omitted or broken out portions are provided by FIGS. 8–10, discussed below.

As shown in FIGS. 4 and 5, this embodiment has a housing 59 which is generally rectangular. It includes a hollow cover 60, hollow side panels 61 and 62 and a hollow bottom pan 63, the respective open volumes within the cover, side panels and pan being filled with insulation 64. Housing 59 also includes end plate 65 at the infeed end of the device and a second end plate 66 at its outfeed end. End braces 67,68 through bottom flanges 74,75, secure end plate 65 to pedestal 78 at the infeed end. Similarly, end braces 69,70, through bottom flanges 76,77, secure end plate 66 to outfeed end pedestal 79. First and second screws 80 and 81 have feed material contacting surfaces 82 and are positioned within housing 59 with their longitudinal axes in parallel alignment, first screw 80 having its flight 83 disposed in a left hand helix for counter clockwise rotation.

Flight 83 of second screw 81 is disposed in a right hand helix for clockwise rotation. Volutes 84 extend between flights 83 on both screws.

As will be described in greater detail in connection with FIGS. 6 and 7 below, each of screws 80 and 81 is connected at its infeed and outfeed ends with axially extending shafts. FIGS. 4 and 5 show infeed end shaft housings 88,89 and outfeed end bearing housings 97,98 which are attached to the respective end plates 36,37 and in which the aforementioned shafts are supported for rotation. At either end of the housing, but preferably at its infeed end, the aforementioned shafts extend from shaft housings 88,89 into a synchronizing means which may for example be contained in housing 90. The synchronizing means is any suitable arrangement for interconnecting the infeed end shafts of screws 80 and 81 so that they will co-rotate or, preferably, counter-rotate, in synchronized relationship, maintaining the flights of the screws in phase so that they do not conflict or bind during rotation. The synchronizing means may for example be as simple as a pair of intermeshing gears located in housing 90 and each being fixedly secured on the infeed end shaft of one of the two screws 80 and 81. An extension 91 from one of these shafts may be connected to the output of a speed reducer 93 having input shaft 94 driven through a gear-belt and pulley arrangement 95 by drive motor 96 mounted in pedestal 78. Motor 96 may be any suitable motor, but it has been found particularly convenient to use a direct current motor which facilitates adjustment of the speed of the motor and therefore of the screws.

Located at the, infeed end of housing 59 is a wet material infeed chute 102 having an upper flange 103, which can be attached to any suitable source of material intended to be heat treated in the apparatus, such as, for example, a conveyor or hopper. As shown in FIG. 4, the infeed ends of screws 80,81 are visible from above through chute 102. In the side view afforded by FIG. 5, the side of chute 102 and portions of side panel 62 are removed to show the interior of the chute and its communication with the infeed ends of the screws 80,81.

A screed chamber wall 104 having an inclined portion 101 visible in FIGS. 4 and 5 and a vertical portion of wall 104 visible in FIG. 5 define a screed chamber 105 within chute 102. Within chamber 105 is a vertically reciprocable screed member 106 having a lower or strikeoff edge 107 which regulates the height of the body of material which moves under the influence of screws 80,81 from chute 102 into an intermediate interior portion 108 of housing 59. This screed is also beneficial from the standpoint of at least partially sealing off the inlet chute 102 for reasons to be discussed below.

Under the influence of screws 80,81, the material flows with components of motion including a component in the direction indicated by flow arrow 109. As indicated above, screws 80 and 81 also have axial shafts extending from their outfeed ends, and these will be described in greater detail in connection with FIGS. 6 and 7 below. However, in FIGS. 4 and 5 portions of cover 60 and side panel 62 are removed to show the outfeed ends of screws 80,81 and their shafts 99,100 which extend through end plate 66 into bearing housings 97 and 98. Housings 97 and 98, secured to end plate 66, contain the bearings for the outfeed end shafts 99,100 as well as certain manifolds and seals for heat-exchange fluid which is introduced into heating chambers, which are formed in the interiors of screws 80,81, and which are depicted and described in and in connection with FIGS. 6 and 7 below. Through the removed portion of side panel 62 in the right hand end of FIG. 5, one may see screw 81 and its shaft 100 in side elevation, above dried material outlet 110, through which material transported by the screw is discharged from housing 59. When the invention is embodied in the form of a single stage, as shown in FIGS. 4–11, dried material outlet 110 may be connected to any desired form of material receiver, such as for example a storage container, transport device or the like, which forms no part of the present invention.

While atmospheric venting of housing 59 is possible, many applications of the invention will not require such venting. As steam or other vapors are discharged through vapor outlet 111 in chute 102, they can be immediately replaced by additional vapors generated by one or more volatile components of the material undergoing treatment in the device. Outlet 111 can be and preferably is equipped with an exhaust fan to withdraw vapors from the interior of housing 59. However, controlling the rate of escape or discharge of vapors from housing 59 (in the sense of limiting that rate) may be beneficial from the standpoints of helping keep the desired temperature in the housing and maintaining desired evaporation rates. On the other hand, if this rate is too low, vaporized component such as steam may recondense, and this will ordinarily be undersiable if the method and apparatus are being operated for drying of the feed material. Thus, according to this particularly preferred embodiment of the apparatus, housing 59 is constructed so as to be substantially gas tight and is fitted with gas lock means, and the flow rate through the blower, if such is provided, is established by experimentation to optimize vaporization and minimize recondensing of water or other volatile component from the feed material. Examples of gas lock means include the above-mentioned screed 106 at inlet chute 102 and, at dried material outlet 110, a flapper-type self- closing door or valve or more preferably a star feeder, neither of which is shown. Such gas lock means and other types of gas lock means may be useful for a variety of purposes, for example for restricting any interchange of ambient air and vapors through chute 102 and outlet 110, which might otherwise reduce the thermal efficiency of the unit.

Figure 6:
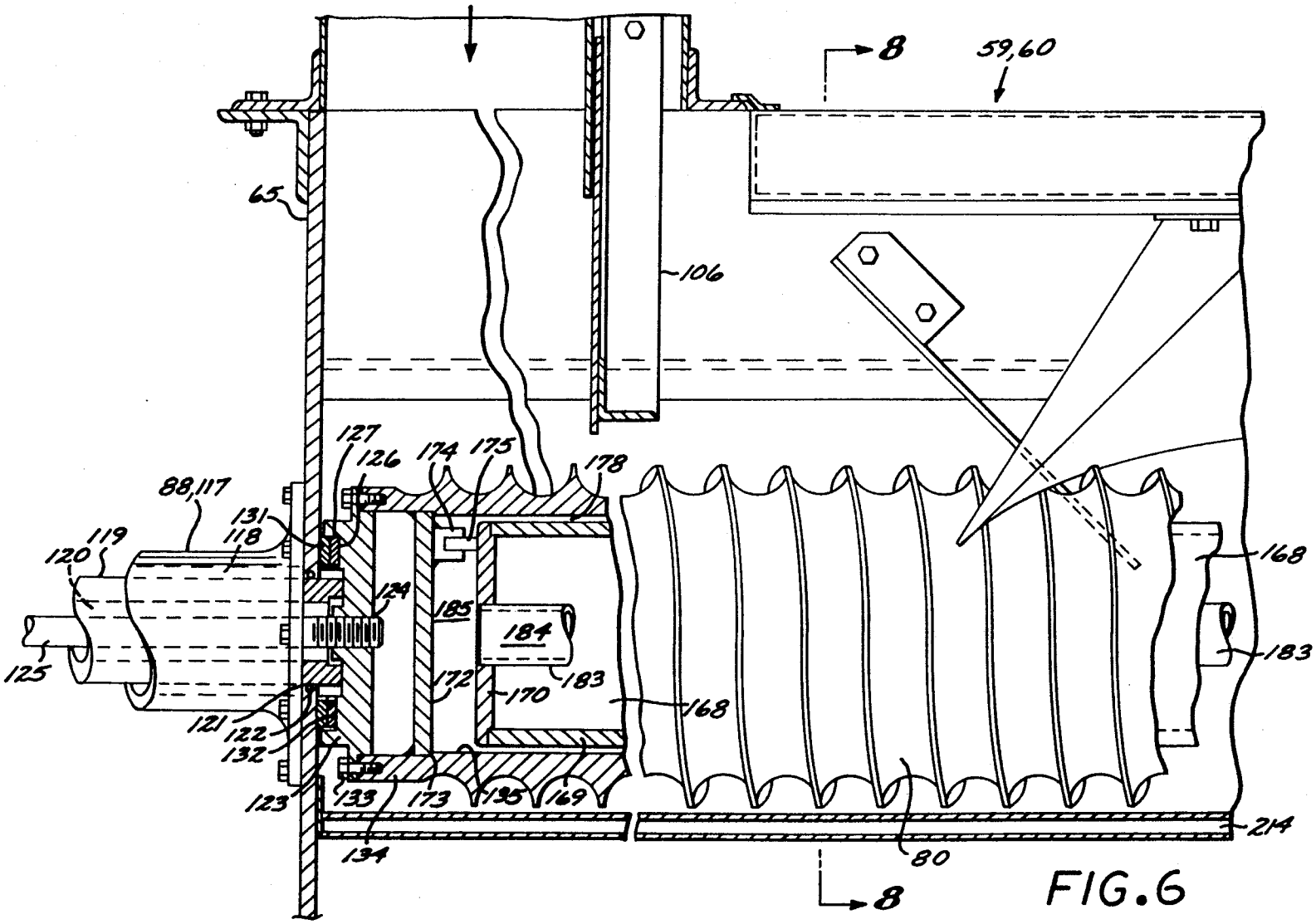
FIG. 6 is an enlarged vertical cross-section of the infeed end of the apparatus of FIG. 5.
Figure 7:
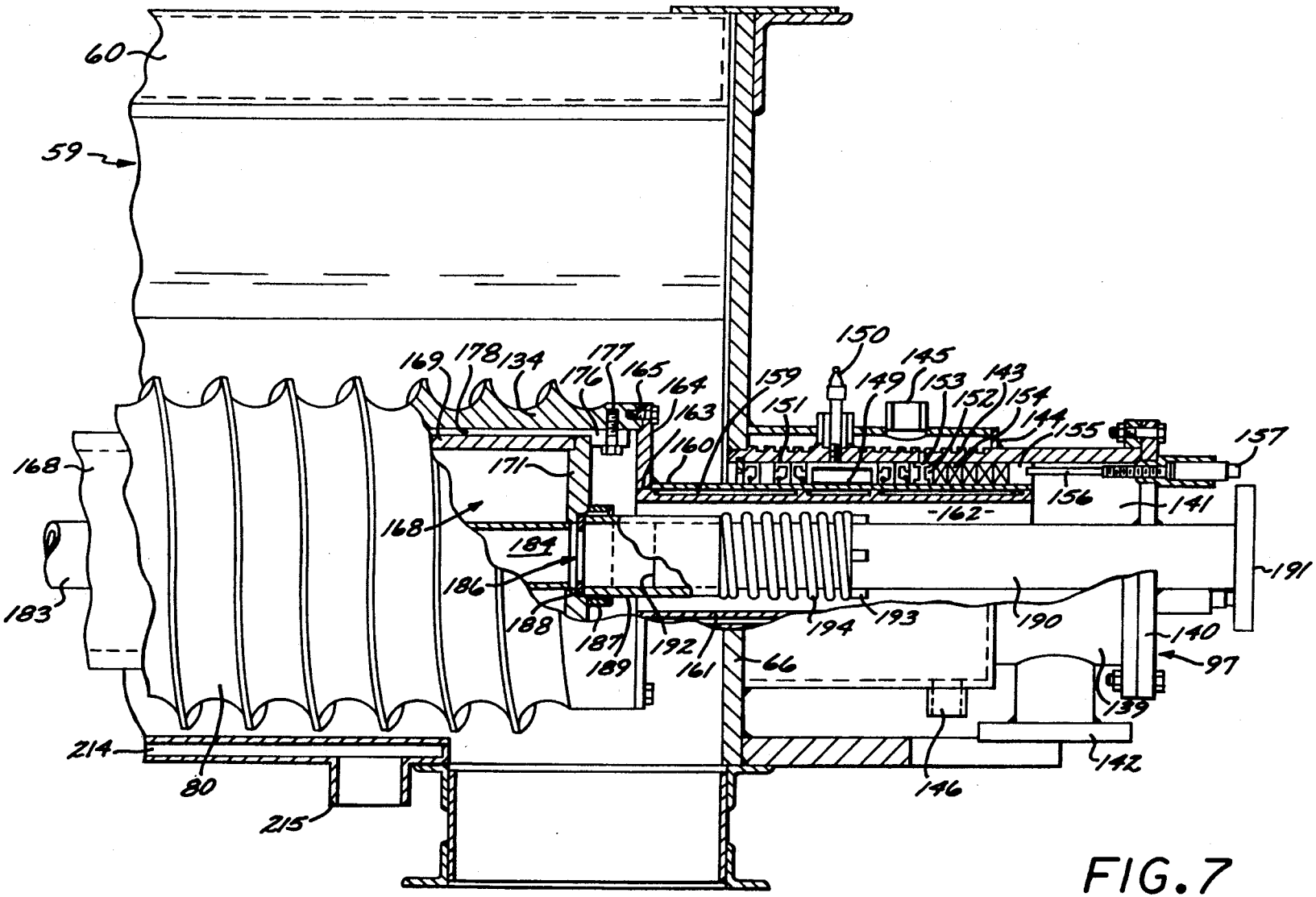
FIG. 7 is an enlarged vertical cross-section of the outfeed end of the apparatus of FIG. 5.

FIGS. 6 and 7

Together, these figures represent enlargements of the left and right ends of the device, as shown in FIGS. 4 and 5, with additional portions broken out. They illustrate a preferred fluid handling system for introducing heat exchange fluid into screws 80,81 and discharging fluid therefrom. For orientation purposes, the reference numerals of a number of the parts described in connection with FIGS. 4 and 5 have been included in FIGS. 6 and 7. Thus, FIGS. 6 and 7 indicate the housing 59, infeed end plate 65, first screw 80 (screw 81 being omitted to make other parts visible), infeed end shaft housing 88, infeed chute 102, screed 106, cover 60, end plate 66 (outfeed end), dried bearing housing 97 and material outlet 110. Portions of housing 97 and of the downstream or outfeed end of screw 80 have been broken out in order to show internal components.

It is contemplated that there may be counter-current flow of feed material and heat-exchange fluid respectively along the outer and inner surfaces of the screw, with the hot fluid transmitting heat through the wall of the hollow screw to the volutes and flights which in turn transmit the heat to the feed material. Also, the fluid entry and discharge ports by means of which heat exchange fluid is admitted into and discharged from the screws may be located at the infeed and/or outfeed ends of the screws. However, it is preferred to provide co-current flow of heat-exchange fluid and feed material along the inner and outer surfaces of the screw, and it has been found most convenient to provide the fluid entry and discharge ports at the outfeed ends of the screws. This mode is therefore illustrated in FIGS. 6 and 7. In these figures, heat-exchange fluid enters the outfeed end of the depicted screw 80 through the bearing housing 97 (FIG. 7), is passed from the outfeed to the infeed end of the screw (FIG. 6) in a manner to be described below, is brought into contact with the inner surface of the screw at its infeed end, travels along the screw inner surface to the outfeed end and is then discharged through the same bearing assembly. This mode of operation will be described in greater detail below.

As shown in FIG. 6, shaft housing 88 includes a tubular casing 117, within which is a longitudinal interior channel 118. Through channel 118 extends a hollow infeed end shaft 119 having an internal bore 120. The left end of shaft 119 is not shown, being journalled in bearings within the synchronizing means housing 90. The right end of shaft 119 extends through an opening 121 (FIG. 6) in end plate 65 which provides a small clearance between the inner surface of the opening and the outer surface of shaft 119. This clearance is closed by a seal 122, e.g., an O-ring, which permits rotation of shaft 119. That portion of shaft 119 which extends beyond end plate 65 into housing 59 engages screw end disc 123 having a central threaded hole 124 therein. Threaded rod 125 extends from hole 124 back through bore 120 in shaft 119 into the synchronizing means, and has been tightened in threaded hole 124 to a sufficient extent so that shaft 119 is bound into a rigid assembly with end disc 123. The end of shaft 119 which engages the end disc has fingers which extend into holes of corresponding size in the face of the disc to transmit torque to the disc. On the left face of disc 123 are an annular ledge 126 and annular collar 127 which respectively serve as a thrust absorbing surface and peripheral retaining means for bearing or thrust rings 131 and 132 positioned in the space between ledge 126 and the inner surface of end plate 65. Bearing rings 131 and 132 are preferably a large bronze washer and a large polished steel washer respectively. End disc 123 is fixedly secured to the end of screw 80 by bolts 133 positioned in a plurality of angularly spaced corresponding holes in the periphery of disc 123 and the end of screw wall 134. The inner surface of screw wall 134 defines the outer surface of a heating chamber within the screw. The rigid connection which exists between this end of the screw and the shaft 119 causes the weight of the infeed end of the screw to be borne by the bearings in the synchronizing means.

As can best be seen in FIG. 7, the opposite end of screw 80 is borne by bearings in bearing housing 97 which includes a cylindrical body 139 having a cap 140 within which is chamber 141 having bottom outlet port 142. Cooling fins 143 are formed about a portion of cylindrical body 139, that portion in which the bearings are supported. Fins 143 are surrounded by water jacket 144 having jacket inlet 145 and outlet 146. In close fitting engagement with the inner surface of the finned portion of body 139 is a roller bearing 149 equipped with grease fitting 150 and protected on its left and right sides by seals 151. The presence of grease under pressure in bearing 149 and behind seals 151 which separate bearing 149 from the interior of housing 59 tend to discourage vapors and liquids such as steam and steam condensate from entering the bearing. Thus, al alternative embodiment of the apparatus would include replacing grease fitting 150 with a reservoir in which a quantity of grease located between a spring-biased reciprocating wall of the reservoir and the tube leading to bearing 149 is continuously urged into the bearing under pressure to replace minor quantities of grease which exudes from the seals into housing 59.

Preferred seals are those which include synthetic rubber or elastomer sealing lips adapted to withstand water, hydrocarbons and temperatures of about 500° F. or more, mounted in circular steel ring housings or supports. For additional protection of the seals and bearing, the bearing and seal assembly is provided with cold ring 152, an annular ring having annular fluid distribution grooves in its inner and outer surfaces, these annular grooves being connected by radial fluid passages such as passage 153. Plural holes through body 139 adjacent the outer annular grooves on cold ring 152 afford circulation of cooling water from jacket 144 through the annular grooves and radial passages 153 to cool the cold ring 152, bearing 149 and adjoining portions of the seals 151 and a hollow outfeed end shaft 161, to be discussed below. To the right of cold ring 152 are additional packing rings 154. These may for example be formed of compressed carbon (e.g. graphite) fiber. With the aid of a follower 155, several threaded adjusting rods extending through cap 140 (only one being shown in the drawing) and then respective actuators 157 (only one being shown) on the outside of the cap, the seals, bearing, cold ring and packing rings may be maintained under suitable compression, which may be adjusted as necessary during operation of the unit.

Within the above-mentioned roller bearing 149, is journalled the hollow outfeed end shaft 161. As shown in the drawing, the shaft is hollow in the sense of having a central end-to-end passage 162 and also includes voids 159 within its cylindrical wall 160. Voids 159 are provided for restricting the rate of heat transfer between hot fluid in passage 162 and the seal-bearing-packing combination described above. A convenient method of fabrication is to form the shaft 161 of inner and outer shells, the inner and/or outer shells having protuberances which hold the shells apart in coaxial relationship. The left end of shaft 161 is welded into the central aperture 163 of screw end disc 164. Bolts 165 in angularly spaced holes about the periphery of disc 164 attach the disc securely to the outfeed end of screw 80.

As may be seen in both FIGS. 6 and 7, a filler member 168 is installed within the heating chamber surrounded and defined by screw wall 134. Filler member 168 is composed of an outer tube 169 having annulus 170 welded to its left end and another annulus 171 welded to its right end. As shown in FIG. 6, a round plate 172 is welded in fluid tight engagement against a ledge 173 of corresponding diameter in the left end of inner surface 135 of screw wall 134. A plurality of sockets 174 (only one being shown for illustration) welded to the right face of plate 172 is positioned for receiving a plurality of pins 175 (only one being shown for illustration) welded to the left end of filler member 168 on annulus 170. Plate 172 being rigidly connected to the screw wall 134, the socket and pin combinations cause the filler member 168 to rotate with the screw. These pins are withdrawable from their respective sockets upon axial motion of the filler member.

The opposite end of the filler member 168, as best shown in FIG. 7, is held in place by a plurality of lugs 176 that are welded to annulus 171 in angularly spaced positions about its periphery. Bolts 177 extending through holes in these lugs secure the lugs and attached filler member to the screw wall inner surface 165. The orientation of filler member 168 is such as to provide an annular, longitudinal passage 178 of relatively small width between the outer surface of the filler member and screw wall inner surface 135. This maintains a thin-film relationship between the screw wall and the heat-exchange fluid which contacts it, thus promoting rapid and thorough transfer of heat from the fluid. To reduce any tendency which may exist for short circuiting or non-uniform flow of fluid through passage 178, it may be subdivided at angular intervals about its central axis into plural longitudinal passages, which may for example be rectilinear or spiral passages.

Within filler member 168 is a central conduit 183, apparent in both FIGS. 6 and 7. Within conduit 183 is a passageway 184 which is in open communication with chamber 185 in FIG. 6 and with a port 186 in FIG. 7, the latter being surrounded by a coaxial, cylindrical shroud 187 and further including a coaxial wear ring 188 which rotates with the screw and the filler member. A short extension pipe 189 has its left end in abutting engagement with one side of ring 188 and its right end in telescoping relationship with a fixed axial inlet pipe 190 having a flange 191 at its outer end and having an inner end 192 extending within extension pipe 189. Pipe 189 is biased against ring 188 by spring 194 which is maintained under compression between the right end of pipe 189 and dogs 193 tack-welded at angularly spaced intervals about the outer surface of inlet pipe 190.

The above-described spring 194 and the telescoping pipes 189,190 perform an important function in absorbing or compensating for differential expansion of the length of the screws 80,81, as compared to the lengthwise expansion of housing 59, especially when the screws and housing are of dissimilar materials, e.g. aluminum and steel, respectively. The spring and telescoping pipes contribute to one of a number of possible embodiments of one of the preferred concepts of the invention which include wall means in the screw(s) supporting the flights and surrounding and defining a heating chamber within at least one of the screw(s), and conduit means for supplying and withdrawing a flow of heat exchange fluid to and from the heating chamber. These conduit means include a first stationary conduit (e.g., pipe 190) having a first end for connection to an external fluid circuit for supplying or withdrawing the heat exchange fluid, a second conduit (e.g., pipe 189) in telescoping relationship with a second end of the first conduit and having a free end disposed in abutment with a rotating port (e.g., 186) in or borne by the screw(s), and means for biasing said free end (e.g., spring 194) toward the port.

Also, it is significant to note that the unit illustrated herein is configured such that relative expansion of the screw is accommodated by longitudinal sliding of the screw end shafts 161 in bearing 149 and seals 151 at the dried material outfeed end of the screw, while steam is discharged near the infeed end of the unit. Because of this configuration, the shaft/seal sliding action occurs away from the zone where the feed material is wettest and away from the zone of maximum steam generation, meaning that there is less steam present to gain admission to the seals 151 and form water in bearing 149.

Figure 9:
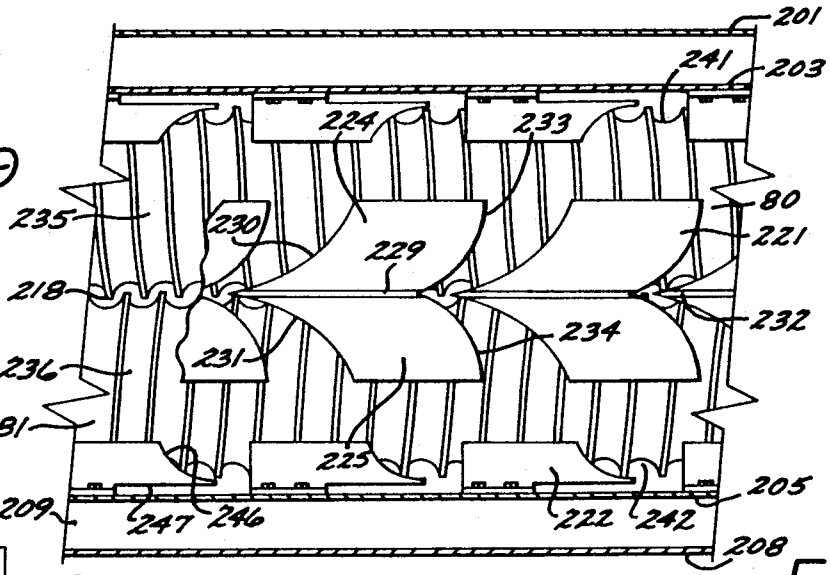
FIG. 9 is a cross-section taken just below the top cover of the apparatus of FIG. 8, taken along section line 9—9 of FIG. 8.
Figure 10:
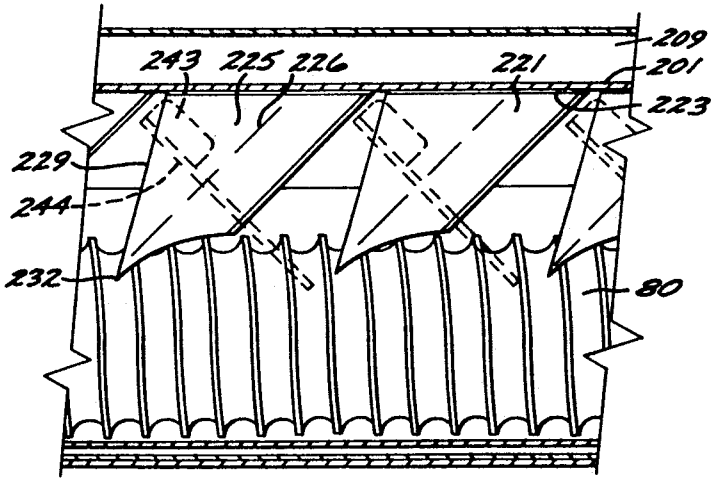
FIG. 10 is a longitudinal cross-section of the apparatus of FIG. 9 taken along section line 10—10 of FIG. 9.
Figure 8:
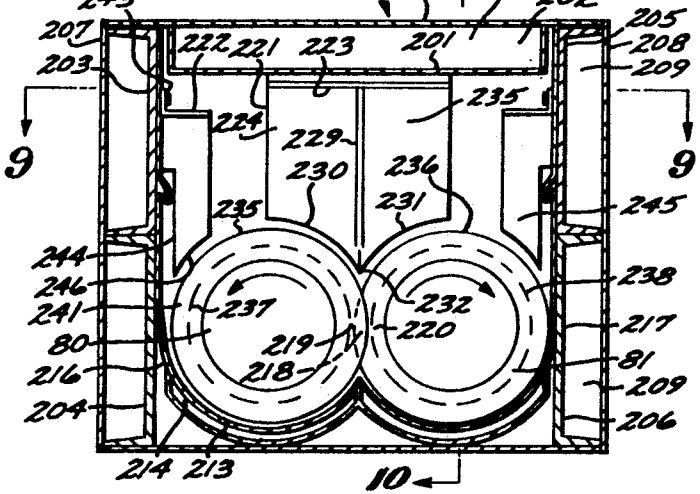
FIG. 8 is an enlarged transverse cross-section of the apparatus of FIGS. 4–7, taken on section line 8—8 of FIG. 6.

FIGS. 8-10, Housing Aspects

For additional details concerning housing 59 and certain preferred embodiments for the processing of material with screws 80,81, please refer to FIGS. 8-10. FIGS. 8-10 are related figures showing internal features of housing 59 which are partly shown in FIGS. 4-7 and which reside in part in the broken out portions of those figures. FIG. 8 is a transverse cross-section taken at section line 8—8 of FIG. 6. FIGS. 9 and 10 show the components of FIG. 8 from different angles, FIG. 9 being a cross-section taken on section line 9—9 of FIG. 8 (so that housing cover 60 is removed) and FIG. 10 being a cross-section of FIG. 8 taken on section line 10—10, the screw 81 being removed so that certain components, which would otherwise be partially hidden, will be visible.

Among other things, FIG. 8 gives a clearer view of certain components of housing 59. As shown in the figure, hollow cover 60 includes a top plate 200 having flanged pan 201 secured to its underside to define a void 202 between them. FIG. 8 shows that hollow side panel 61 of FIGS. 4-7 is fabricated from a pair of flanged beams 203,204 each beam having one of its flanges secured in abutting relationship to a corresponding flange of the adjacent beam and having the flanges extending in an outward direction relative to the inside of chamber 59. Side plate 207 bridging across the spaces between the beam flanges defines voids 209. Similarly, hollow side panel 62 of FIGS. 4-7 is composed of flanged beams 205,206 with side plate 208 defining additional voids 209. FIG. 5 shows that hollow bottom pan 63 also defines a void which has been omitted from FIGS. 6-10 to save room. As indicated by the discussion of FIGS. 4 and 5, any or all of these voids may be and preferably are filled with insulating material to prevent heat losses through the housing walls. In the alternative, the voids can be jackets for circulation of heat exchange fluid either for heating the contents of the housing and/or for the recovery of heat therefrom. Of course, when these voids are used as heat exchange fluid jackets, they may themselves be surrounded by insulation (not shown).

Preferably, the apparatus includes confining means, one or more members extending longitudinally of the screw adjacent its periphery and subtending a substantial portion of the arc of such periphery when viewed in transverse cross-section. The confining means assists or causes maintenance of contact between the screw volutes and feed material undergoing treatment by the screws, such contact being maintained by the confining means until the material approaches an elongated mixing zone 218 extending longitudinally between the uprunning portions 219,220 of screws 80,81. The confining means preferably includes an arcuate bottom trough 213, including a pair of arcuate portions generally corresponding to the arcs of screws 80,81. Trough 213 preferably also includes a fluid duct 214, also preferably arcuate and corresponding to the arcs of the screws, and having an inlet (not shown) and an outlet 215 (FIG. 7). The confining means may and preferably does also include chamber liners 216,217 which closely approach the peripheries of these screws at their sides.

Spreaders and Diverters

Rapid vaporization and expulsion of volatile component(s) from the feed material at the feed material/ volute interface(s) can result in formation of a hardened surface layer on the surface of the feed material which conforms to the cross-section of the volute. According to an optional but definitely preferred and beneficial modification of any of the methods of the present invention, the vaporizing and expelling of at least one volatile component from the sludge or other feed material is caused to take place at said interface(s) sufficiently rapidly, in sufficient quantity and on a continuing basis for converting at least that portion of the sludge or other material which is present at the interface(s) to a form which is essentially non-adherent to the screw(s) and for retarding sticking of the foulant to the screw(s) during said conversion. The conversion of the interface portion of the material may involve drying, scorching, hardening, searing, polishing and/or other processes which perform the indicated functions and which may for simplicity be referred to as "case-hardening".

According to a further optional but preferred and beneficial modification of the foregoing, the feed material at the interface(s) is converted to a non-adherent form which is a shell of dried or solidified feed material or sludge present at said interface(s) and surrounding a lower solids content and/or lower viscosity material within. This shell has sufficient strength to temporarily move tangentially as a unit with the material within, but is, during a substantial portion of its travel in the longitudinal direction along the screw(s), sufficiently weak to be broken apart and to expose the material within in response to mixing loads imposed on the shell by the screw(s) and or other members with which the material comes in contact. The foregoing mode of operation provides particular advantages when it is used to form a shell of dried waste activated sludge present at said interface(s) and surrounding a lower solids content higher moisture content) sludge within.

The non-adherent material or shell described above can bind together elongated chunks of feed material which are expressed or extruded upwardly from the mixing zone. In other instances, there still may be surface hardening but less well defined chunks or balls of material. With or without formation of identifiable chunks conforming to screw volute cross-section, such surface hardening, in combination with slippage between the screw(s) and the material filling the volutes in the mixing zone, tends to inhibit sticking of feed material to the screw(s).

Because of this slippage between the screw volute(s) and the surface hardening of the material undergoing treatment in contact with the screw(s), or for other reasons, circumstances can arise in which it may be desirable to enhance the mixing action of the screws by additional members present within the housing. It has been found that notwithstanding the surface hardening and possible formation of chunks of material the mixing action of the dryer can be enhanced by employment of certain spreaders which may be employed in the method and apparatus of the present invention. It has also been found that where material is distributed to the laterally diverging portions of the screws by spreader members or otherwise, the mixing action of the dryer can be enhanced by use of certain side diverters. It is considered best to employ center spreaders and diverters in combination. These options are employed in preferred embodiments of the method and apparatus which are discussed below.

According to a preferred option for use in connection with any of the method embodiments of the invention, when they include plural, counter-rotating screws, lifted sludge or other feed material is intercepted intermittently and at a plurality of longitudinally spaced locations in or adjacent the mixing zone upper portion as it moves in the downstream direction, by bringing it into contact with spreader members which adjoin the closely adjacent flights of the screws in said pair or pairs of screw(s). Intercepted material is further lifted and distributed, by the spreader members, across divergently running portions of the surfaces of the screws in said pair(s).

In another preferred method option, usable with the spreader members or any other suitable means for performing the above-mentioned distributing function, divergently running portions of the screws laterally shift the material toward lateral zones extending longitudinally between down-running portions of the screws and confinement members extending along the down-running portions. This causes the material to be moved downstream along upper portions of the lateral zones. Laterally shifted material, intermittently and at a plurality of longitudinally spaced locations in or adjacent said lateral zone upper portions, is intercepted as it moves in the downstream direction by bringing it into contact with diverter members which adjoin the upper portions of the lateral zones. These diverter members urge the material into the lateral zones for engagement and downward motion with the down-running portions of the screws for promoting the mixing of the material and the removal of the volatile component(s) therefrom.

In one of two preferred apparatus options, which are for use in connection with any of the foregoing apparatus embodiments when they include plural, counter-rotating screws, the screws are positioned for lifting the feed material by co-action of uprunning portions of the screws and for causing the material to move generally upward from the elongated mixing zone between the screws with a tangential component of motion and to move downstream along an upper portion of the mixing zone. Spreader members adjoin the closely adjacent flights of the screws in the above-mentioned pair or pairs of screw(s) for (a) contacting and intercepting the lifted material, at a plurality of longitudinally spaced locations in or adjacent the mixing zone upper portion, as it moves in the downstream direction, and (b) further lifting the material and distributing it onto divergently running portions of the surfaces of the screws in said pair(s).

In the second preferred apparatus option, usable with the spreader members or any other suitable means for performing the above-mentioned distributing function, the screws are positioned for using their divergently running portions for laterally shifting the material toward lateral zones. These extend longitudinally between down-running portions of the screws and confinement members extending along said down-running portions. The screws are also positioned for causing the material to move downstream along upper portions of the lateral zones. Diverter members adjoin the upper portions of the lateral zones for contacting and intercepting the laterally shifted material, at a plurality of longitudinally spaced locations in or adjacent said lateral zone upper portions, as it moves in the downstream direction. They urge the material into the lateral zones for engagement and downward motion with the down-running portions of the screws for promoting the mixing of the material and the removal of the volatile component(s) therefrom.

FIGS. 8-10, Spreader and Diverter Aspects

Figure 11:
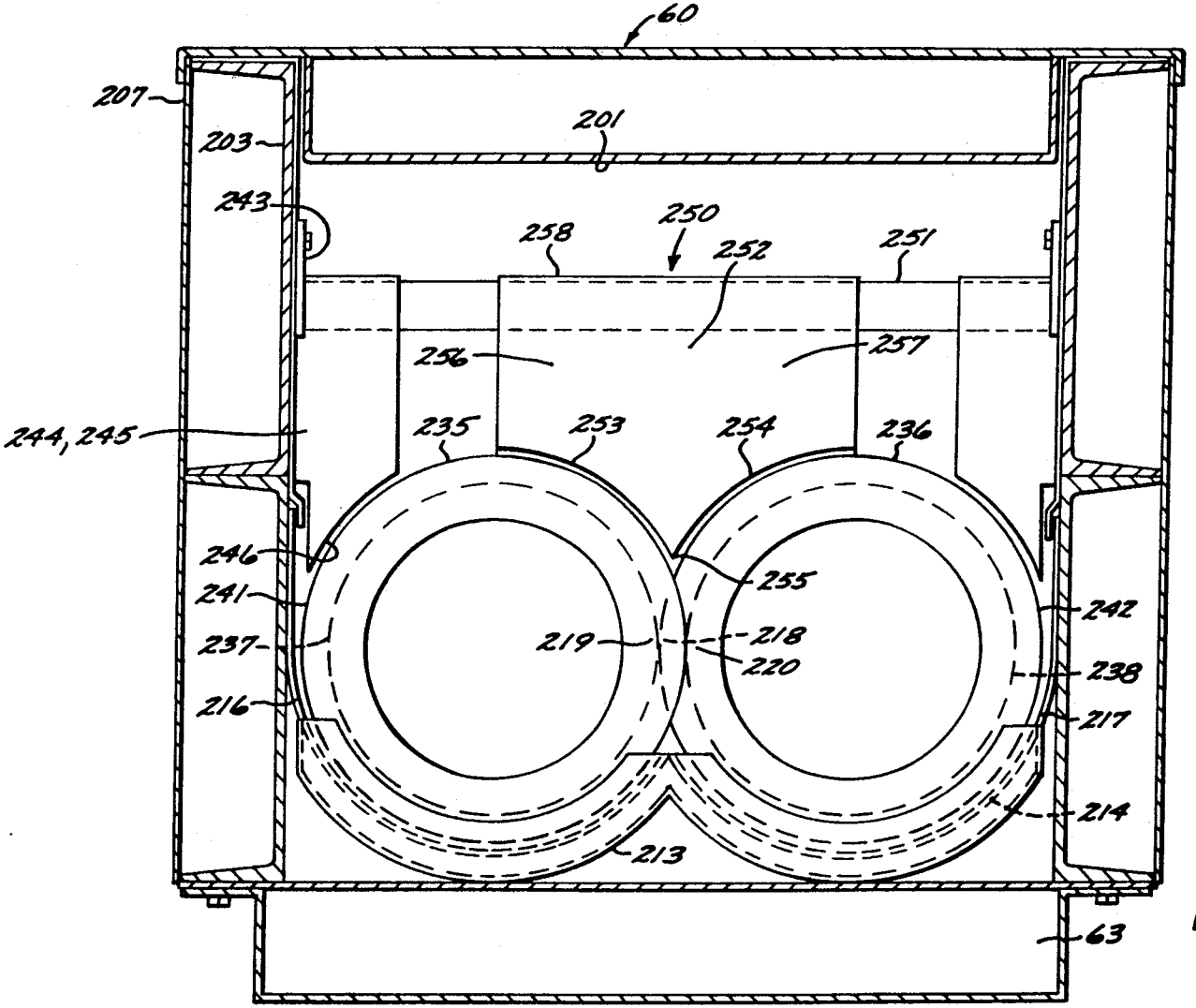
FIG. 11 is an enlarged transverse cross-section of a modified form of the apparatus of FIGS. 4–7, taken from a position similar to that of FIG. 8.

FIGS. 8-10 contain examples of the center spreaders and side diverters mentioned above, e.g., center spreaders 221 and side diverters 222. Examples of these members are visible in FIGS. 5 and 6 in portions of the figures from which side panel 62 has been removed. According to an optional but preferred embodiment of the invention, the apparatus is provided with a series of such center spreaders, as more clearly shown in FIGS. 8-10. Optionally, but preferably, as also shown in FIGS. 8-10, a plurality or series of side diverters is employed in conjunction with the center spreaders. FIG. 11, discussed below, illustrates the center spreaders.

Thus, according to FIGS. 8-10, in one embodiment of center spreaders 221, these spreaders each include bed plates 223 positioned at longitudinally sequenced locations along the underside of flanged pan 201 of cover 60. To each bed plate are welded the upper edges of a plurality of pairs of plow members, e.g., first and second plow members 224 and 225. The surfaces of these plow members represent irregular portions of cylinders formed about generating axes, such as axis 226 visible in FIG. 10. These axes are inclined upwardly in the downstream direction and may be disposed in vertical planes that are perpendicular to a plane which includes the axes of the screws 80,81. Edge 229 is formed by the intersection of the arcuate surfaces of these plow members, and the same surfaces have arcuate edges 230,231. Together, edges 229,230 and 231 meet in a point 232 which lies just above the zone in which the screws intermesh. Arcuate edges 230,231 extend closely adjacent to the edge of the volume traversed by the tips of the flights of screws 80,81, so that these edges are in position for intercepting materials discharged upwardly from elongated mixing zone 218 by uprunning screw portions 219 and 220. As viewed in FIG. 8, plow members 224 and 225 are in position for contacting the intercepted material, dividing it into left and right portions at edge 229 and distributing it across divergently running screw portions 235 and 236, respectively. The intercepting, lifting and distributing action of the spreader members promotes the mixing of the feed material and the removal of the volatile component(s) therefrom.

The above-mentioned side diverters 222 are useful without center spreaders 221, but are preferably used with the center spreaders or another device capable of performing the function of distributing material from the mixing zone across divergently running portions of the surfaces of the screws. The side diverters are useful for handling material which has been shifted laterally by the divergently running portions of the screws. The side diverters may be embodied in any form which is adapted to urge laterally shifted material into lateral zones extending longitudinally between downrunning portions of the screws and confinement members extending along these downrunning portions.

Thus, in the illustrative embodiment seen in FIGS. 8-10, the lateral zones 237 and 238 extend along the length of the screws where the downrunning screw portions 241,242 confront chamber liners 216,217. Each side diverter 222 is, in this preferred embodiment, composed of a tab 243, by which it is secured to the inner surface of housing 59 above the downrunning portion of one of the screws. In each diverter member, tab 243 supports an inclined strip 244 which is inclined downwardly, e.g., at an angle of about 45°, in the downstream direction. The lower end of strip 244 includes an arcuate edge 246 which is positioned close to the edge of the volume in which the corresponding screw flight tip rotates. The sides 247 of strips 244 are preferably closely adjacent to the inner surface of the housing or other confinement member, such as confining means 216,217, to prevent material from circumventing the strip around sides 247.

In operation, laterally shifted material moves towards the lateral zones 237,238 and moves downstream along upper portions of these zones. As the material moves downstream, it is intercepted by the undersides 245 of inclined strips 244 on diverters 222 and is urged by the diverters into the lateral zones for engagement and downward motion with the downrunning portions 237,238 of the screws. The foregoing actions of interception of the material and urging of it into the lateral zones takes place intermittently and at a plurality of longitudinally spaced locations corresponding to the positions of the series of diverter members provided at longitudinally sequenced positions along the interior of housing 59.

Center Spreaders, FIG. 11

FIG. 11 discloses another arrangement of the spreader members which is preferred because it occupies less of the transverse cross-section of the upper portion of the housing, thereby facilitating the longitudinal flow of gases (including vapors) in that portion of the housing. In this embodiment, center spreaders 250 are substituted for center spreaders 221. Spreaders 250 depend from transverse hangers 251 spaced downwardly from the underside of flanged pan 201 of cover plate 60. Because spreaders 250 depend from transverse hangers 251 mounted well below the bottom of cover 60, they interfere less with the longitudinal flow of gases in the upper reaches of the housing. This may be seen by a comparison of FIGS. 8 and 11.

Where side diverters are used, the diverters and the ends of transverse hangers 251 may be co-located and commonly secured to housing side panels 61 and 62 by common fastening means. Each of a series of longitudinally spaced transverse hangers 251 has secured to its mid-section a flat spreader plate 252 welded or otherwise secured thereto. As in the prior embodiments, the spreader plates are inclined upwardly in the downstream direction. Preferably, each hanger 251 is arranged so that it is entirely beneath its plate 252, thereby offering no obstruction for the passage of material up over the top and rear of the plate. In common with the prior embodiments, the spreader plates have arcuate intercepting edges 253,254 meeting at points 255. The spreader plate left and right sides 256,257, appearing to the left and right of points 255 divert and distribute material as in the prior embodiments.

Figure 12:
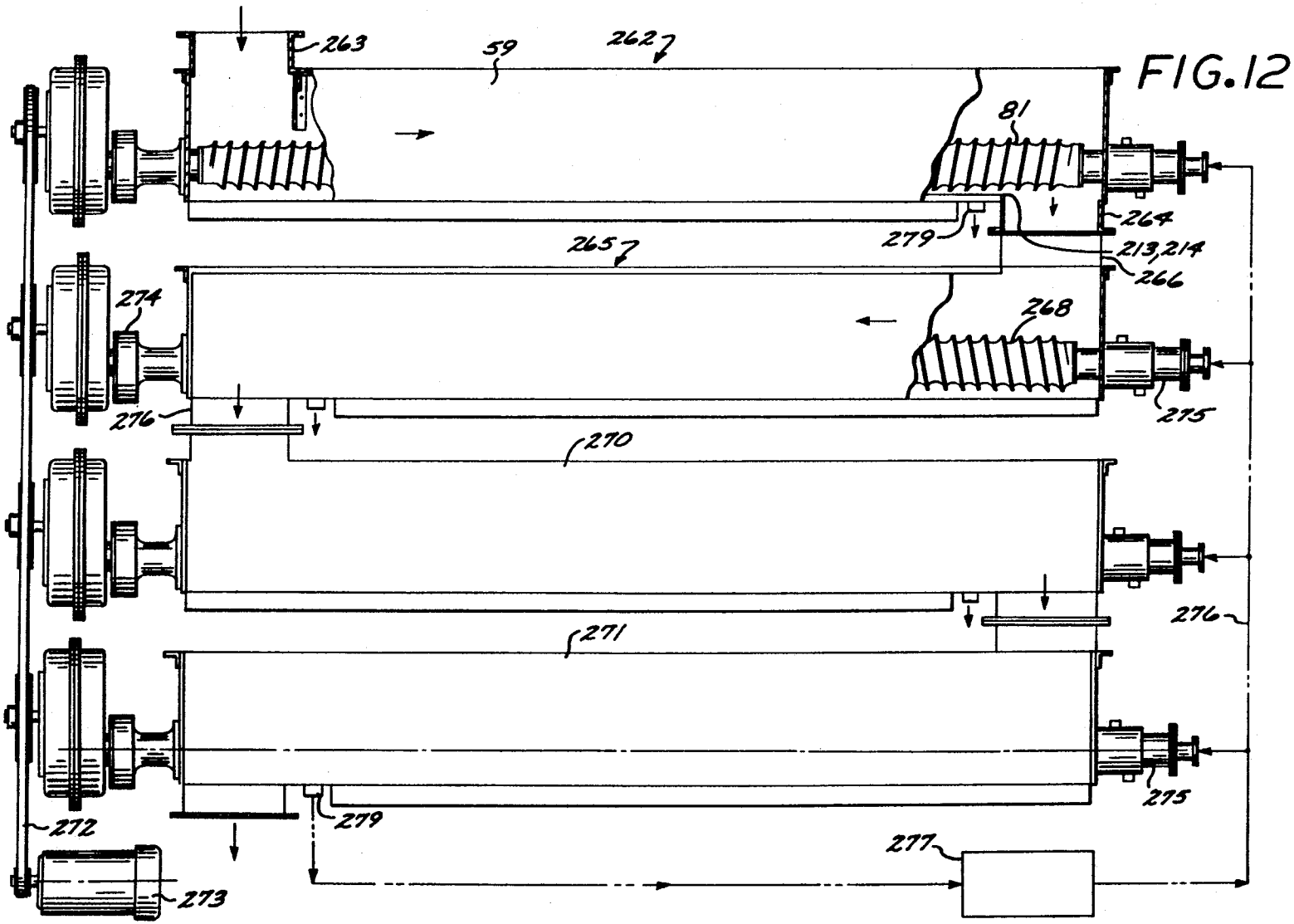
FIG. 12 is a schematic diagram showing a stacked, sequential arrangement of units similar to those shown in FIGS. 4–11, adapted to perform a series of drying treatments on a flow of material cascading through the units.
Figure 13:
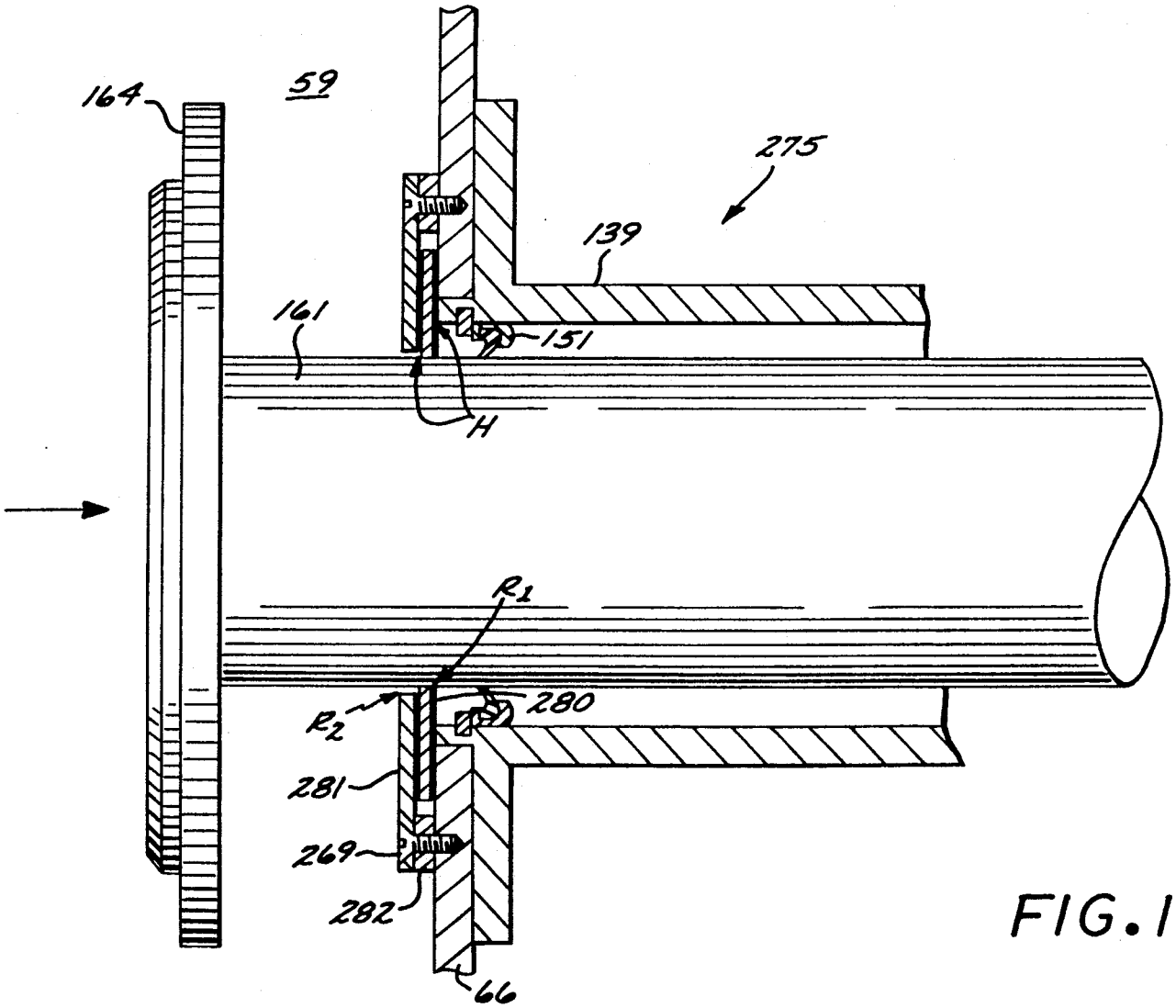
FIG. 13 is an enlarged portion of FIG. 12, with broken out portions which are partly similar to a portion of FIG. 7.

FIGS. 12 and 13

The most preferred embodiment of the invention is a cascading unit identical to what has already been discussed in connection with FIGS. 4-11, except that a plurality of the FIGS. 4-11 units are arranged in sequence, so that material discharged from the outlet of one unit enters the inlet of the next unit in a series of two or more such units. FIG. 12 illustrates a cascading type dryer in which four twin-screw units similar to those shown in FIGS. 4-11 are stacked so that the material flow in the top and third units is from left to right, while material flow in the second and fourth units from the top is from right to left. FIG. 13 illustrates a shaft sealing arrangement useful in certain portions of the FIG. 12 embodiment.

First unit 262 of FIG. 12 includes an inlet chute 263, housing 59, screws 80,81 (only screw 81 being visible in this drawing) and outlet chute 264. Chute 264 is directly connected to inlet chute 266 of a second unit 265 having screws 268, only one of which is visible in the view. The flights on screws 268 are of opposite hand as compared to the screws 80,81 in first unit 262 and thus urge the material from right to left in the second unit, causing it to discharge through outlet chute 267.

As will be appreciated from the foregoing, first unit 262 is virtually identical to the unit of FIGS. 4–10. The second unit is almost identical except that its screws are of opposite hand, its means 275 for the admission and discharge of heat exchange fluid is at its infeed end, its driving means 274 is at its outfeed end and it has certain refinements shown in FIG. 13. The third and fourth units 270,271 are replications of the first and second units 262,265, respectively By virtue of the fact that the respective units all have their driving means 274 at the left, they can be driven by a common motor 273, through a common drive connection 272. In the operation of a cascading or multi-phase unit, situations may be encountered in which the feed material either shrinks or increases in volume, i.e., fluffs up, during processing. In such circumstances, it may be necessary or desirable to rotate the screws in subsequent units at faster or slower speeds than the screws in preceding units. For example, in the case of a material which expands, it may be beneficial to arrange the drives for some or all of the subsequent units in the series so that they each run faster than the immediately preceding unit in order to prevent back-up of the material and to keep it feeding smoothly through the equipment. On the other hand, other materials, for example, that waste activated sludge, shrink during drying. Assuming this to be the case, it will usually be beneficial to arrange the drives for some or all of the subsequent units in the series so that they each run slower than the immediately preceding unit. This helps keep subsequent units filled and tends to preserve drying efficiency.

In common with the unit shown in FIGS. 4–11, the individual units 262,265,270,271 of the FIG. 12 embodiment may each be provided with confining means 213 including fluid ducts 214 closely adjacent to the bottom of the screws for auxiliary heating purposes. These ducts may be provided with inlets, not shown, to supply hot heat exchange fluid thereto. As shown in FIG. 12, these ducts may be provided with outlets 279 from which spent heating fluid may be conducted through gathering conduits 278 (one being shown for illustration) to a fluid heater.

Since all four units 262,265,270 and 271 in FIG. 12 have their heat exchange fluid inlet and outlet means 275 at their right hand ends, they may be connected by a common supply conduit 276 to a common fluid heater 277. In such an arrangement, second and fourth units 265,271 will be receiving relatively wetter material through their respective feed material inlet chutes adjacent their respective fluid inlet and outlet means 275 and discharging relatively dryer material at their left ends than if operated as a single unit, e.g., outlet chute 267 of unit 265. Because the fluid inlet and outlet means 275 include screw end shafts 161, passing through seals 151 and roller bearings 149 (FIG. 7), and because the design of each unit is arranged in such a manner as to accommodate differential expansion of the screws 80,81 relative to housing 59 by relative longitudinal movement of the screws and the shafts relative to the seals and bearings, expansion and contraction of the screws can cause a certain "pumping" action of sludge, water and steam against the seals. It appears that in a unit in which relatively wetter material may be entering housing 59 adjacent seals 151 that it may be necessary or desirable to provide some additional barrier against penetration of steam and/or water through the seals into the bearings 149. This is illustrated in FIG. 13.

FIG. 13 is an enlarged portion of the right-hand end of unit 265 of FIG. 12, and specifically shows a portion of the fluid inlet and outlet means 275. This fluid inlet and outlet means 275 is identical to that in fourth unit 271, and includes a cylindrical body 139 attached to housing end plate 66. End plate 66 and body 139 are, however, at the infeed ends in units 265 and 271, whereas the corresponding parts are located at the outfeed ends of first and third units 262 and 270. Body 139 has associated with it essentially all of the components that are shown in association with body 139 in FIG. 7, including fins, a water jacket, a roller bearing, a grease fitting, seals, a cold ring, packing and so forth, but most of these components have been omitted from FIG. 13 for sake of simplicity. Only a portion of one representative seal 151 is included in this figure. The figure also includes shaft 161 and screw end disc 164, which are identical to the corresponding parts in FIG. 7.

In FIG. 13 the interior of housing 59 and its contents are isolated from seals 151, and from the bearings, packing and other elements of the rotational supports for the shafts 161 on each screw. This is accomplished, in both units 265 and 271, by annular washer-like rings 280, whose inner diameters have a very small clearance $R_1$ with the exterior surface of shaft 161, e.g., on the order of 0.0005–0.001 inches. This fit is close enough to prevent passage of sludge and to discourage the passage of steam and/or liquid water from the interior of housing 59 through this clearance to seals 151. The fit is preferably snug enough to cause ring 280 to rotate with shaft 161 while permitting longitudinal slippage of shaft 161 relative to the ring upon expansion and contraction of the screw attached to screw end disc 164. The outside diameter of rings 280 is sufficiently large to cover the annular gap between shaft 161 and the inner surface of cylindrical body 139.

To maintain ring 280 in its proper position, a non-rotating keeper 281 is provided. Like ring 280, it is a flat annular ring, but its outer diameter is substantially larger than that of ring 280. Also the inner diameter of keeper 281 is slightly larger than that of ring 280, providing the keeper with a larger clearance $R_2$ between shaft 161 and its inner diameter, e.g., 0.005–0.010 inches. With the aid of machine screws 269 and an annular spacer ring 282, keeper 281 is maintained in parallel and spaced relationship to end plate 66 in such a way as to form an annular pocket which is open only in the radially inward direction and which surrounds and retains ring 280, the latter having a clearance H between its left and right surfaces and the respective adjoining surfaces of ring 281 and end plate 66. Clearance H, which is present on both sides of ring 280, may for example be about 0.001–0.003 inches. In a cascading arrangement for the drying of materials which shrink during drying, as does waste activated sludge, it will usually be beneficial to arrange the drive for some or all of the subsequent units in the series so that they each run slower than the immediately preceding unit. This helps keep subsequent units filled and tends to preserve drying efficiency.

FIGS. 14–16

Figure 16:
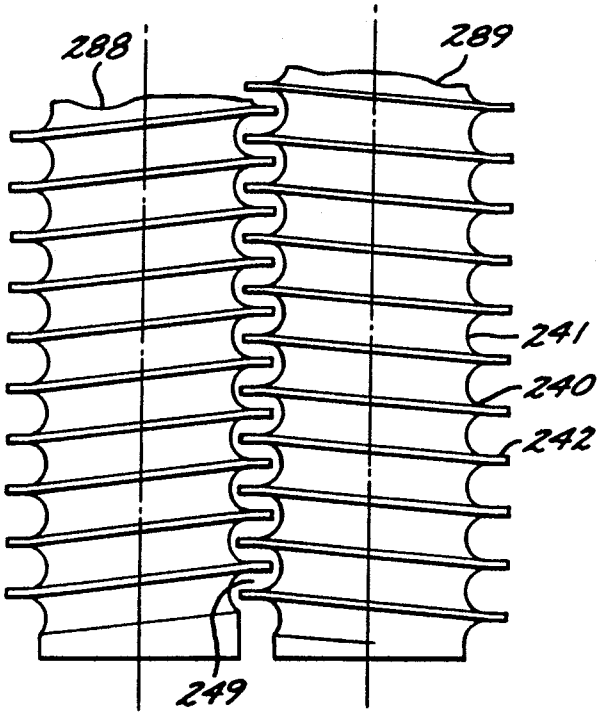
FIG. 16 is a schematic view of a modification of FIG. 14 showing spatial relationships of screws having interleaving flights with radial extensions to promote heat transfer and mixing.
Figure 15:
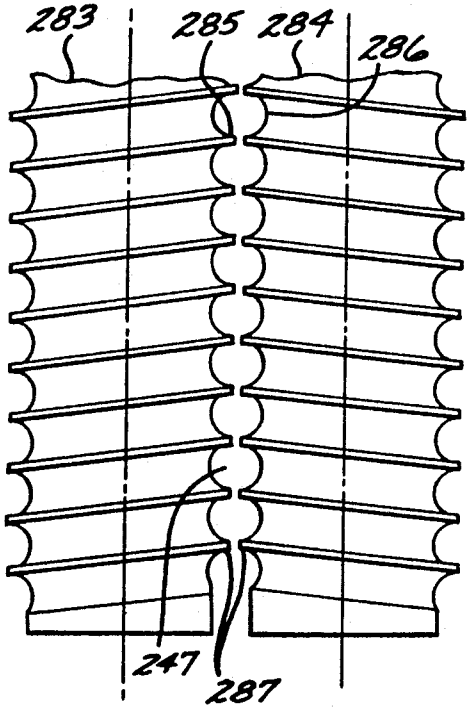
FIG. 15 is a schematic view of a modification of FIG. 14 showing spatial relationships of screws having their flights arranged in tip to tip relationship.
Figure 14:
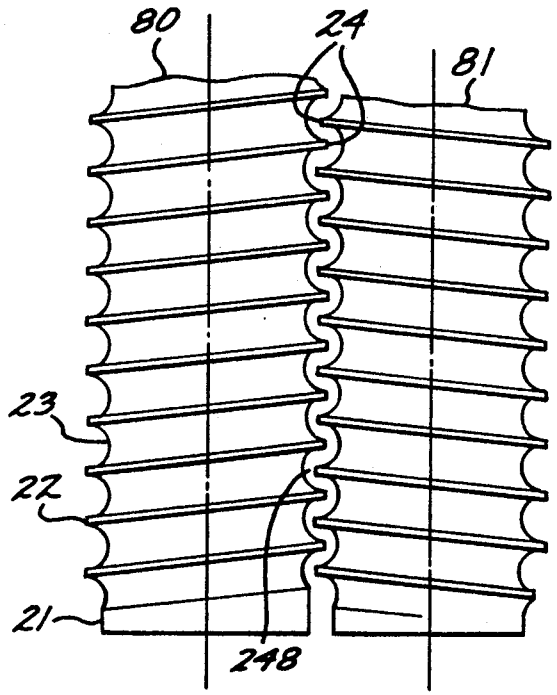
FIG. 14 is a schematic view showing the spatial relationships of the adjacent portions of two screws and their flights, and particularly the interleaving of the flights in a manner similar to that used in the embodiments of FIGS. 4–11.

FIG. 14 provides an enlarged view of the screws 80,81 employed in the units of FIGS. 4–13. These screws include shanks 21, flights 22, volutes 23 and intermeshing tips 24 as shown in FIG. 1. FIGS. 15 and 16 show alternative arrangements of the screws which are also contemplated for use in connection with the invention.

Thus, FIG. 15 discloses first and second screws 283,284 having flights 285, and volutes 286 so arranged that the flight tips 287 are maintained in confronting or tip-to-tip relationship as the screws rotate.

FIG. 16 shows still another screw arrangement which may offer some promise of improvement over the embodiments of FIGS. 14 and 15. The FIG. 16 embodiment includes first and second screws 288,289 with flights 240 and volutes 293 which are basically oriented in intermeshing relationship as in FIG. 14. However, the flights of the FIG. 16 embodiment have been provided with flight extenders 294, helical ribbons of metal welded to the flight tips so that they extend deeper into the volute of the adjoining screw.

The embodiment of FIG. 16 may be formed, starting with screws similar to those shown in FIG. 14. Rings may be cut from metal having the same thickness as the flight tips, these rings having the same inner diameter as the outer diameter of the flights. The outer diameters of the rings will be the same as the desired outside diameter of the completed screw when the flight extenders are in place. After making a single radial cut through each ring, the ring may be formed into what is essentially a single turn of a helix and be welded onto the tip of the flight of the screw. Enough of these single helixes are applied to the flight to extend its diameter as desired throughout all or any portion of the length of the screw. The resulting welds are polished as described above.

While the dimensions may be varied as necessary or desirable, an illustrative screw having a 10½ inch diameter includes volutes with a 1 inch radius and tips with a ⅛ inch thickness, resulting in a 2⅛ inch lead or pitch. Flight extenders are applied to increase the screw radius by ⅞ inches, and the resultant screw is mounted with an adjoining screw in such a manner that the tips of the flight extenders are ⅜ inch from the bottoms of the adjoining volutes, resulting in a 1½ inch overlap between the outer tips of the flight extenders on the adjoining screws.

Intermeshing screws, as shown in FIGS. 14 and 16, appear to have significant advantages over the tip-to-tip arrangement shown in FIG. 15. Note now the free space 295 between the volutes of screws 283,284 of FIG. 15 is generally elliptical, while the free space 248,249 of FIGS. 14 and 16 is smaller, being penetrated by flights 22 and flight extenders 294, respectively. Such penetration is believed to produce a better mixing action. Intermeshing screws also appear to be more capable of tolerating the passage of small tramp metal items such as bolts through the apparatus. Moreover, they may offer advantages with respect to heat transfer between the screw and the material under treatment. It appears at present that the FIG. 16 embodiment may prove superior in both mixing and heat transfer, as compared to the arrangement shown in FIG. 14.

FIGS. 17–18

The effectiveness of the dryers of the present invention can be enhanced by preheating of the feed material and/or by recovery of heat from a variety of sources in the process and apparatus. Preferably, these alternatives are practiced in combination.

Preheating can be applied in an upstream portion of the apparatus of the present invention in which the feed material may contact any kind of heating member or surface, including a screw, or even a cooler-running portion or portions of the same screw(s) used in carrying out the invention. However, it is preferred to preheat in a chamber and/or apparatus that is separate from that in which the present invention is conducted.

Heat may be recovered through jackets surrounding hot components of the apparatus. This includes the main housing in which the screws contact the feed material for carrying out the process of the invention. If used, the boiler for heating heat exchange fluid for screw(s) may also be jacketed for heat recovery purposes. Another source of heat is by-product gaseous material such as steam produced by the removal of volatile component(s) from the feed material.

Figure 17:
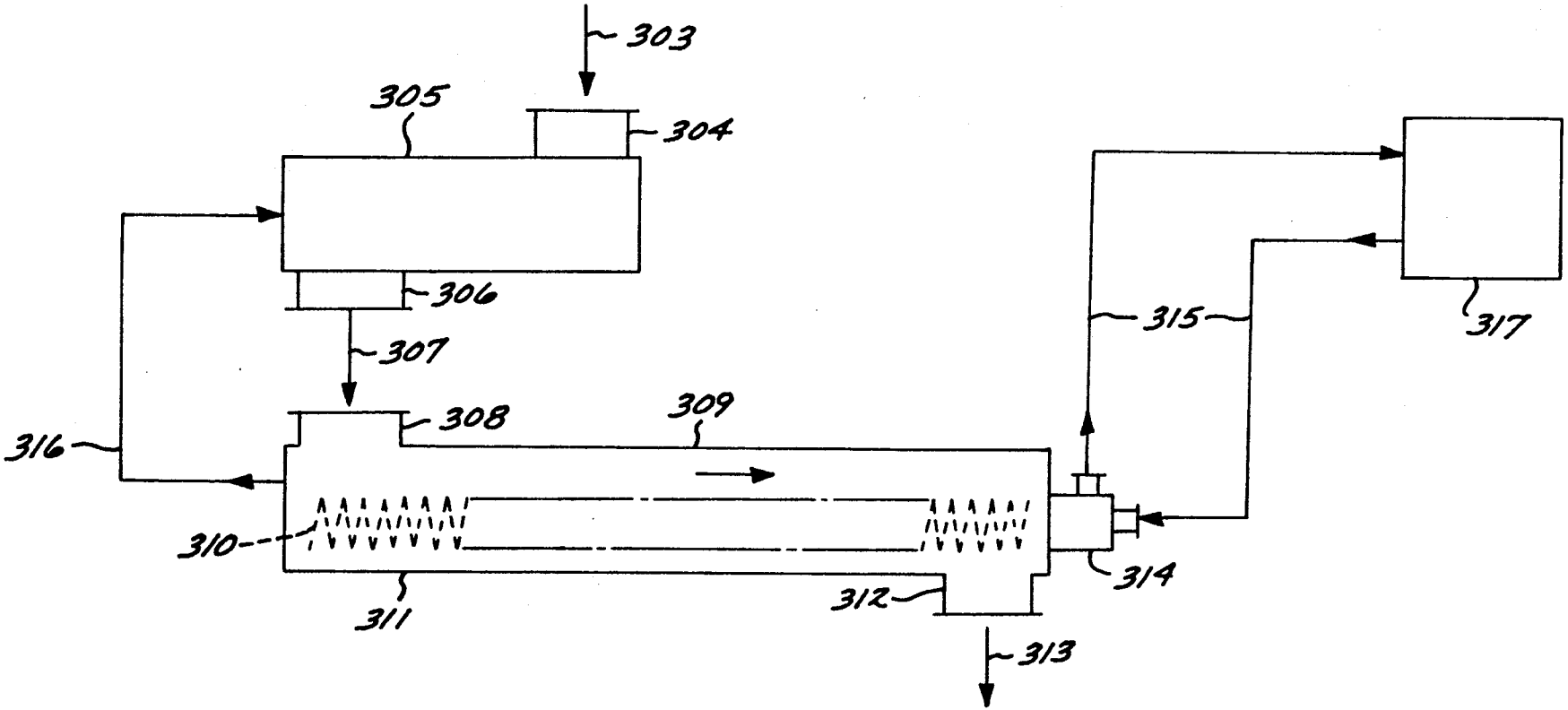
FIG. 17 is a schematic diagram showing apparatus similar to that shown in FIGS. 3–11, connected with a feed preheater arranged to supply preheated feed that has been heated with by-product vapors.
Figure 18:
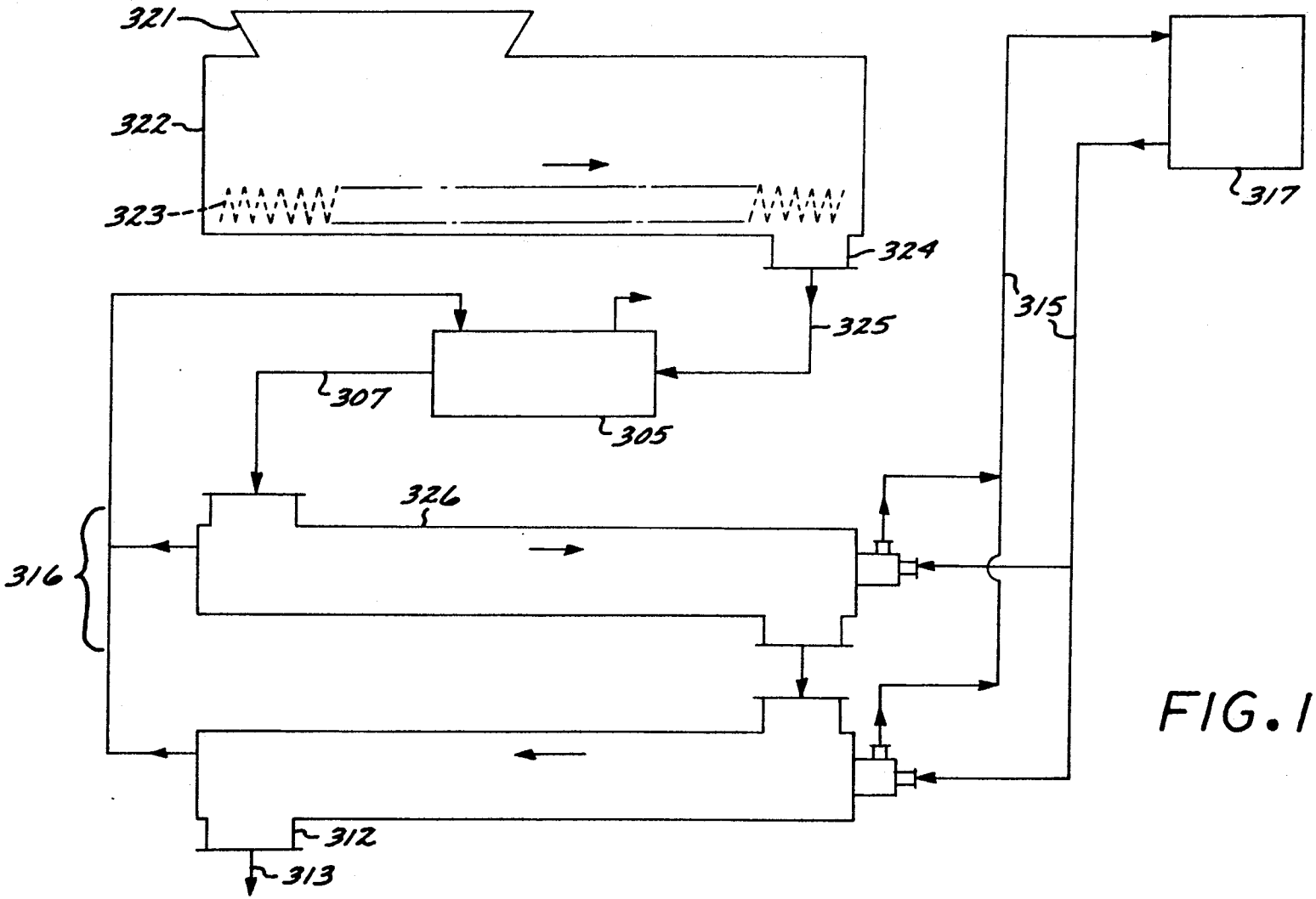
FIG. 18 is a schematic diagram showing apparatus similar to that shown in FIGS. 12 and 13, connected with a feeder and a preheater arranged to supply preheated feed that has been heated with by-product vapors.

Preferred options, among many which could be devised, are illustrated for example in FIGS. 17–18, FIG. 17 being a simple schematic diagram of one preheating arrangement in which feed material 303 enters inlet 304 of preheater 305. Any suitable form of preheater may be used, and it is presently preferred that the preheater be any suitable housing having hot surfaces within it for contacting the feed material and means such as screws, drag chains or the like to move material across the hot surfaces. From the preheater outlet 306 preheated material 307 is transported to inlet chute 308 of dryer 309. The dryer may be any form of dryer in accordance with the present invention including for example those shown in FIGS. 3, 4–10, 11 and 12. The dryer includes one or more screws 310 in housing 311 from which dried material 313 is discharged through discharge chute 312.

Heat exchange fluid for the drying operation enters screws 310 through heat exchange fluid inlet and outlet means 314 which may for example be similar to that shown in FIG. 7. A supply and recycle loop 315 cycles heat exchange fluid between a boiler 317 or other heater and the interiors of screws 310. Vapors 316 released from the feed material are recycled to the preheater 305, for preheating the feed material 303 prior to its entry into dryer 309.

FIG. 18 discloses a somewhat more preferred form of preheating arrangement in which feed material enters the inlet 321 of a live-bottom hopper 322 having an activator 323 therein, which may be a screw or other conventional activating device. Hopper 322 releases through its outlet 324 a volume-flow-controlled stream of feed material into preheater 305 similar to that shown in FIG. 17. Preheated material 307 then enters dryer 326 which is similar to that in FIGS. 12 and 13, except that only two of the four units have been shown in this figure to conserve space. As in the prior embodiment dried material 313 is released through a discharge chute 312. Heat exchange fluid is cycled back and forth between the screws in the dryer and boiler 317 through a supply and recycle loop 315. Vapors 316 released from the feed material in dryer 326 are directed to the preheater 305 in which they are employed to preheat the feed material prior to its entry into the dryer. Although the preheating arrangement just described is the one presently preferred, it should be evident that a wide variety of preheating and pretreating arrangements for the feed material may be used without departing from the spirit of the invention.

EXAMPLE

A dryer substantially as depicted in FIGS. 4–10 is employed having twin counter-rotating screws which are 8 feet long, are 10.5 inches in diameter, have volutes of semi-circular cross-section with a radius of one inch, have flights whose tips are one eigth inch wide, have a pitch, of 2⅛ inches and have a helix angle of 3.7 degrees. The screws are of 6061-T6 aluminum alloy turned from a continuously cast billet and polished with abrasive paper and polishing rouge to a roughness average (Ra) estimated to be about 4–8. The flights of the two screws are in tip-to-tip relationship in the manner shown in FIG. 15. No scrapers, balls or other cleaning members are present in contact with the screws. Center spreaders and side diverters as depicted in FIGS. 8–10 are provided.

While turning at about 22 r.p.m. and internally heated with hot oil, the screws are fed with a flow of feed material which is aqueous, gelatinous waste activated sludge stabilized and dewatered with a centrifuge to a water content of about 85 percent. No dried material is mixed with the wet feed. The oil is heated in a boiler which running full time, burns 55 pounds (20,000 BTU per pound) of kerosene per hour. The hot oil enters the screws at a temperature of about 600 degrees Fahrenheit, passes between the screw walls and the filler members (FIGS. 6 and 7) in a film about 0.1 inches thick and is discharged from the screws at about 575° F., while evaporating up to 500 pounds of water per hour.

The rate of expulsion of water vapor and of heating of the wet feed material at the volute/feed material interfaces is so rapid that the feed material "extrudes" or expresses upwardly from between the screws in chunks having cylindrical surfaces whose radii correspond to the radius of the screw volutes. These chunks comprise at their surfaces hardened, seared or scorched material which is distributed, broken and remixed with the remainder of the material under the influence of the screws, center spreaders and side diverters as the material is conveyed downstream in the unit.

The material is partially dried in a first pass through the unit, and the partially dried material is collected. Different samples are dried to various final moisture contents ranging from about 60% down to about 5% or less, based on the weight of moisture free sludge solids, using one or several passes through the unit, as required. After the last material discharged in a given pass has been discharged, any large lumps (if any) and any hard balls of sludge which may have formed during the first pass (if any) are broken up by passing the material through a hammer mill or other flailing disintegrator, before the material is returned to the dryer inlet for additional passes, such lump-breaking being repeated if and as necessary between passes. After several passes without blending of dried product with wet feed, some of the samples of feed material are dried to the extent that they freely emit air-borne dust and are estimated to have a moisture content approaching zero percent, i.e., less than 5%.

Approximately 40 tons (wet basis) of material are processed in the above-described manner in the same unit with a cumulative period of operation of more than 500 hours, excluding periods of shut-down for inspection, maintenance and crew rest. Throughout this period, the screws remain clean and unfouled with feed material. During periods of shut-down, some formation of a coating (believed to be an aluminum oxide coating) appears on the screws. This is polished away by the feed material when the unit is returned to operation. Small nicks or scratches formed in the hot screw surfaces during drying, by contact with hard materials or objects in the feed material, also appear to smooth over during subsequent operation of the unit.

This example demonstrates the successful drying of aqueous pasty sludge material including foulant(s), which has pronounced tendencies to cake, agglomerate and stick, using a heated screw dryer, without any recycling of dried product into the wet feed. During the operation the screws remain completely clear of foulant deposits and are not cleaned with scrapers, balls or alternative cleaning means other than hardened, seared or scorched sludge wiping the volute/feed material interfaces of the screws.

We claim:

1. An apparatus for drying feed material comprising:

at least one screw member including at least one helical-shaped flight having a helix angle of about 10 degrees or less, said flight forming a continuous helical volute depression for contacting said feed material, said volute depression having a smooth contact surface with a roughness of about 63 micro-inches or less to a assist in the prevention of adherence of feed material foulants to said volute depression;

means for injecting and discharging said feed material into and from said screw member for transporting said feed material through said drying apparatus;

means for rotating said screw member;

means for heating said screw member; and means for spreading said feed material within said volute depression of said screw member, whereby said drying apparatus operates at heat transfer rates for a time period sufficient to reduce the moisture content of said feed material without mechanically cleaning said screw member of said feed material foulants.

2. The apparatus of claim 1 wherein said screw member is formed about a shank extending through said apparatus.

3. The apparatus of claim 1 wherein the depth and contour of said volute depression minimizes adherence of said sludge.

4. The apparatus of claim 2 wherein said shank is hollow.

5. The apparatus of claim 1 wherein said smooth contact surface of said volute depression is treated for improving wear and corrosion resistance.

6. The apparatus of claim 1 wherein a surface layer of said screw member is comprised of a non-ferrous metal.

7. The apparatus of claim 6 wherein an abrasion resistant surface layer of said screw member is comprised of Corten.

8. The apparatus of claim 6 wherein an abrasion resistant surface layer of said screw member is comprised of titanium.

9. The apparatus of claim 1 wherein a surface layer of said screw member is comprised of a chromium plated steel alloy.

10. The apparatus of claim 6 wherein a surface layer of said screw member is comprised of magnesium.

11. The apparatus of claim 6 wherein a thermally conductive surface layer of said screw member is comprised of a beryllium-copper alloy.

12. The apparatus of claim 6 wherein a thermally conductive surface layer of said screw member is comprised of an aluminum alloy.

13. The apparatus of claim 1 wherein the depth of said volute depression is approximately equal to the pitch of the helical-shaped flight of said screw.

14. The apparatus of claim 1 wherein said screw member is formed by an extrusion and polishing process.

15. An apparatus for drying feed material comprising:

at least one screw member including a plurality of continuous helical windings of tubular stock mounted about a mandrel, said windings forming continuous helical volute depressions for contacting said feed material, said volute depressions having a smooth contact surface to a assist in the prevention of adherence of feed material foulants to said volute depression;

means for injecting and discharging said feed material into and from said screw member for transporting said feed material through said drying apparatus;

means for rotating said screw member;

means for heating said screw member; and means for spreading said feed material within said volute depressions of said screw member, whereby said drying apparatus operates at heat transfer rates for a time period sufficient to reduce the moisture content of said feed material without mechanically cleaning said screw member of said feed material foulants.

16. An apparatus for drying feed material comprising:

at least one screw member including a plurality of continuous helical windings of tubular stock mounted about a shaft, said windings forming continuous helical volute depressions for contacting said feed material, said volute depressions having a smooth contact surface to a assist in the prevention of adherence of feed material foulants to said volute depression;

means for injecting and discharging said feed material into and from said screw member for transporting said feed material through said drying apparatus;

means for rotating said screw member;

means for heating said screw member; and means for spreading said feed material within said volute depressions of said screw member, whereby said drying apparatus operates at heat transfer rates for a time period sufficient to reduce the moisture content of said feed material without mechanically cleaning said screw member of said feed material foulants.

17. The apparatus of claim 1 wherein said heating means is comprised of a plurality of resistance heating elements resident within said screw member.

18. The apparatus of claim 1 wherein said heating means comprises a plurality of passages within said screw member for housing a layer of heat exchange fluid.

19. The apparatus of claim 1 wherein said heating means comprises a wall within said screw member for supporting said helical-shaped flight, said wall having an inner surface defining a heating chamber.

20. The apparatus of claim 1 wherein said heating means includes a heating chamber having a volume exceeding approximately half the total volume of said screw member.

21. The apparatus of claim 1, further including means for inhibiting an interchange of a plurality of ambient gases with a plurality of volatile gases located within said injecting means.

22. The apparatus of claim 19 wherein said heating chamber further includes means for supplying and withdrawing the heat exchange fluid to and from said heating chamber.

23. The apparatus of claim 19 wherein said heating chamber further includes a filler enclosure having an outer surface adjacent to said wall within said screw member for forming a heat exchanging device.

24. The apparatus of claim 1 wherein said heating means includes a layer of heat exchange fluid for transferring heat between a heat source and said screw member.

25. An apparatus for drying feed material comprising:

at least one screw member including at least one helical-shaped flight, said flight forming a continuous helical volute depression for contacting said feed material, said volute depression having a smooth contact surface to a assist in the prevention of adherence of feed material foulants to said volute depression;

means for injecting and discharging said feed material into and from said screw member for transporting said feed material through said drying apparatus, said screw member positioned within said injecting means for regulating the height of the feed material contacting said screw member within said injecting means;

means for rotating said screw member;

means for heating said screw member; and means for spreading said feed material within said volute depression of said screw member, whereby said drying apparatus operates at heat transfer rates for a time period sufficient to reduce the moisture content of said feed material without mechanically cleaning said screw member of said feed material foulants.

26. The apparatus of claim 1 further including a secured bearing means for receiving and rotationally supporting a shaft extending axially through said screw member and having a plurality of seals for isolating said hearing means.

27. The apparatus of claim 26 wherein said bearing means and said plurality of seals further include an annular cooling ring having a plurality of annular fluid distribution grooves in communication with an external source of cooling fluid for withdrawing heat from said bearing means and said plurality of seals.

28. The apparatus of claim 1 wherein said screw member comprises a plurality of screws with at least a portion of a first screw being in juxtaposition with a corresponding portion of a second screw for providing a mixing zone and for moving said feed material along said screw member.

29. The apparatus of claim 1 wherein the temperature of said smooth contact surface of said volute depression communicating with said feed material is approximately four hundred degrees Fahrenheit.

30. The apparatus of claim 1 wherein said volute depression includes an open cross-section being divergent in the radially outward direction for resisting adherence of said waste activated feed material to said smooth contact surface of said volute depression.

31. The apparatus of claim 1 wherein said rotating means comprises an electric motor.

32. The apparatus of claim 1 wherein said screw member includes a plurality of screws comprised of at least one pair of counter-rotating screws having an axis substantially parallel to an axis of a second screw member of said pair of screw members.

33. The apparatus of claim 32 further including a synchronizing means for interconnecting a shaft for each of said plurality of screws comprising said screw member for providing a synchronized relationship between each of said helical-shaped flights of said plurality of screws.

34. The apparatus of claim 32 further including speed control means for controlling the speed of said plurality of screws.

35. The apparatus of claim 1 further including means for exhausting a plurality of vapors from within said apparatus for optimizing vaporization of a plurality of fluids and for minimizing recondensation of said fluids within said feed material.

36. The apparatus of claim 1 further including heat-exchange fluid within said heating means for entering an outfeed end of said screw member through a hearing housing, said heat-exchange fluid being transported to an infeed end of said screw member and further contacting an inner surface of said screw member when redirected to said outfeed end and discharged through said bearing housing.

37. An apparatus for drying feed material comprising:

at least one screw member including at least one helical-shaped flight, said flight forming a continuous helical volute depression for contacting said feed material, said volute depression having a smooth contact surface to a assist in the prevention of adherence of feed material foulants to said volute depression;

screw member bearing means having a bearing housing surrounded by a plurality of cooling fins, said cooling fins being surrounded by a water jacket for removing heat from said secured bearing means;

means for injecting and discharging said feed material into and from said screw member for transporting said feed material through said drying apparatus;

means for rotating said screw member;

means for heating said screw member; and means for spreading said feed material within said volute depression of said screw member, whereby said drying apparatus operates at heat transfer rates for at time period sufficient to reduce the moisture content of said feed material without mechanically cleaning said screw member of said feed material foulants.

38. The apparatus of claim 1 wherein said heating means further includes a heating chamber comprised of a filler member mounted within an inner surface of said screw member, said filler member including an annular, longitudinal passage adjacent to said inner surface of said screw member for providing transfer of heat from a heat exchange fluid.

39. An apparatus for drying feed material comprising:

at least one screw member including at least one helical-shaped flight, said flight forming a continuous helical volute depression for contacting said feed material, said volute depression having a smooth contact surface to a assist in the prevention of adherence of feed material foulants to said volute depression;

means for injecting and discharging said feed material into and from said screw member for transporting said feed material through said drying apparatus;

means for rotating said screw member;

means for heating said screw member including a heating chamber comprised of a filler member mounted within an inner surface of said screw member, said filler member including an annular longitudinal passage adjacent to said inner surface of said screw member for providing transfer of heat from a heat exchange fluid and further including a plurality of telescoping pipes and a biasing spring member for compensating for differential temperature expansion along the length of said screw member; and means for spreading said feed material within said volute depression of said screw members, whereby said drying apparatus operates at heat transfer rates for a time period sufficient to reduce the moisture content of said feed material without mechanically cleaning said screw member of said feed material foulants.

40. The apparatus of claim 1 further including a means for preheating said feed material prior to feeding said feed material to said injecting means.

41. The apparatus of claim 40 further including a fluid jacket surrounding said preheating means for recovering energy escaping from said apparatus.

42. An apparatus for drying a feed material comprising:

a plurality of screws, each of said screws including at least one helical-shaped flight having a helix angle of about 10 degrees or less, each flight forming a continuous helical volute depression for contacting said feed material, said volute depression having a smooth contact surface with a roughness of about 63 micro-inches or less for preventing the attachment of feed material foulants;

means for injecting and discharging said feed material into and from said plurality of screws for transporting said feed material through said drying apparatus;

means for driving said plurality of screws;

means for heating said plurality of screws for drying said feed material and for resisting adherence of said feed material to said plurality of screws;

a heating chamber formed within said heating means of each of said screws for providing a fluid heat exchanging means, wherein said drying apparatus operates for extended time periods for reducing the moisture content of said feed material without mechanically cleaning said plurality of screws of said feed material foulants.

43. An apparatus for drying a feed material comprising:

a plurality of screws, each of said screws including at least one helical-shaped flight, each flight forming a continuous helical volute depression for contacting said feed material, said volute depression having a smooth contact surface for preventing the attachment of feed material foulants;

means for injecting and discharging said feed material into and from said plurality of screws for transporting said feed material through said drying apparatus;

a plurality of spreader members positioned adjacent to said plurality of screws for distributing said feed material across said screws and for assisting in the removal of a plurality of volatile gasses;

means for driving said plurality of screws;

means for heating said plurality of screws for drying said feed material and for resisting adherence of said feed material to said plurality of screws;

a heating chamber formed within said heating means of each of said screws for providing a fluid heat exchanging means, wherein said drying apparatus operates for extended time periods for reducing the moisture content of said feed material without mechanically cleaning said plurality of screws of said feed material foulants.

44. An apparatus for drying a feed material comprising:

a plurality of screws, each of said screws including at least one helical-shaped flight, each flight forming a continuous helical volute depression for contacting said feed material, said volute depression having a smooth contact surface for preventing the attachment of feed material foulants;

means for injecting and discharging said feed material into and from said plurality of screws for transporting said feed material through said drying apparatus;

a plurality of diverter members for urging said feed material into a plurality of lateral zones for providing efficient mixing of said feed material between said plurality of screws;

means for driving said plurality of screws;

means for heating said plurality of screws for drying said feed material and for resisting adherence of said feed material to said plurality of screws; and a heating chamber formed within said heating means of each of said screws for providing a fluid heat exchanging means, wherein said drying apparatus operates for extended time periods for reducing the moisture content of said feed material without mechanically cleaning said plurality of screws of said feed material foulants.

45. A method for drying feed material comprising the steps of:

providing at least one screw member;

forming at least one helical-shaped flight having a helix angle of about 10 degrees or less on said screw member, said flight forming a continuous volute depression with a smooth contact surface having a roughness of about 63 micro-inches or less for receiving said feed material;

injecting said feed material into said continuous volute depression for transporting said feed material across said screw member;

rotating said screw member;

spreading said feed material within said volute depression for drying;

operating said screw member at heat transfer rates for a time sufficient to reduce the moisture content of said feed material without mechanically cleaning said screw member of feed material foulants; and discharging said dried feed material from said screw member for completing said drying method.

46. The method of claim 45 further including the step of providing a volute depression having a cross-section diverging in the radially outward direction for resisting adherence of said feed material to said volute contact surface.

47. The method of claim 45 further including the step of operating said screw member at high temperature for extended time periods for reducing the moisture content of said feed material without mechanically cleaning said screw member of said feed material foulants.

48. The method of claim 45 further including the step of operating said screw member at high temperature for extended time periods for reducing the moisture content of said sludge without mechanically cleaning said screw member of said feed material foulants.

49. A method for drying feed material comprising the steps of:

providing at least one screw member;

forming at least one helical-shaped flight on said screw member, said flight forming a continuous volute depression with a smooth contact surface for receiving said feed material;

injecting said feed material into said continuous volute depression for transporting said feed material across said screw member;

rotating said screw member;

providing a heating chamber and a thin film heat exchanger;

transferring heat from said heating chamber to said smooth contact surface of said volute depression by means of said thin film heat exchanger;

spreading said feed material within said volute depression for drying;

operating said screw member at heat transfer rates for a time sufficient to reduce the moisture content of said feed material without mechanically cleaning said screw member of feed material foulants; and discharging said dried feed material from said screw member for completing said drying method.

50. The method of claim 45 further including the step of preheating said feed material prior to injecting said feed material into volute depression.

51. The method of claim 45 further including the step of synchronizing an end shaft of each of a plurality of screws of said screw member for providing a synchronized relationship between each of said plurality of screws.

52. The method of claim 45 further including the step of controlling the speed of a motorized driver for controlling the speed that a plurality of screws of said screw member are driven.

53. The method of claim 45 further including the step of intercepting said feed material for distributing said feed material across a plurality of screws of said screw member and for removing at least one of a plurality of volatile components resident within said feed material.

54. The method of claim 45 wherein said step of heating said volute depression further includes the step of transferring heat from a plurality of resistance elements to said smooth contact surface of said volute depression.

55. The method of claim 45 further including the step of recovering energy escaping from said method of drying for improving the efficiency of the method.

56. The apparatus of claim 1 wherein said screw member is comprised of a plurality of contiguous helical windings of tubular stock mounted about a shank.

* * * * *